US005747940A

United States Patent [19]

Openiano

[11] Patent Number: 5,747,940

[45] Date of Patent: May 5, 1998

[54] MULTI-DIMENSIONAL CONTROL OF ARRAYED LIGHTS TO PRODUCE SYNCHRONIZED DYNAMIC DECORATIVE PATTERNS OF DISPLAY, PARTICULARLY FOR FESTIVAL AND CHRISTMAS LIGHTS

[76] Inventor: Renato M. Openiano, 934 Fuchsia La., San Diego, Calif. 92154

[21] Appl. No.: 585,209

[22] Filed: Jan. 11, 1996

[51] Int. Cl.[6] ..... F21P 1/02

[52] U.S. Cl. ..... 315/185 S; 362/252; 362/806

[58] Field of Search ..... 362/249, 252, 362/806, 122, 123; 315/185 S, 185 R, 312, 194, 195, 291, 307, 294

[56] References Cited

U.S. PATENT DOCUMENTS 3,789,211 1/1974 Kramer ..... 315/185 S
5,245,519 9/1993 Openiano ..... 362/252

*Primary Examiner*—Robert Pascal
*Assistant Examiner*—David Vu
*Attorney, Agent, or Firm*—William C. Fuess

[57] ABSTRACT

A number of voltage and ground buses—normally four or more each of which respectively connects to groups of lights within a large number of lights that are typically both multicolored and regularly geometrically arrayed in two and three dimensions—are separately simultaneously selectively energized in order to produce dynamic decorative patterns of display, particularly for use as Christmas lights. Buses are preferably selectively enabled and energized in at least four major and ten or more minor combinations in order to, along with differences in sequencing and phasing and timing, produce great numbers of different display patterns, typically at least ten such patterns that are recognizable to an observer. The progressive displays of a great number of individual light arrays may be coordinated in both (i) synchronization, and (ii) repetition rate, by the simple expedients of (i) applying a.c. line power to all light arrays in common at the same time, and (ii) selecting by wire jumpers a fundamental repetition rate at each light array.

37 Claims, 12 Drawing Sheets

FIG. 13
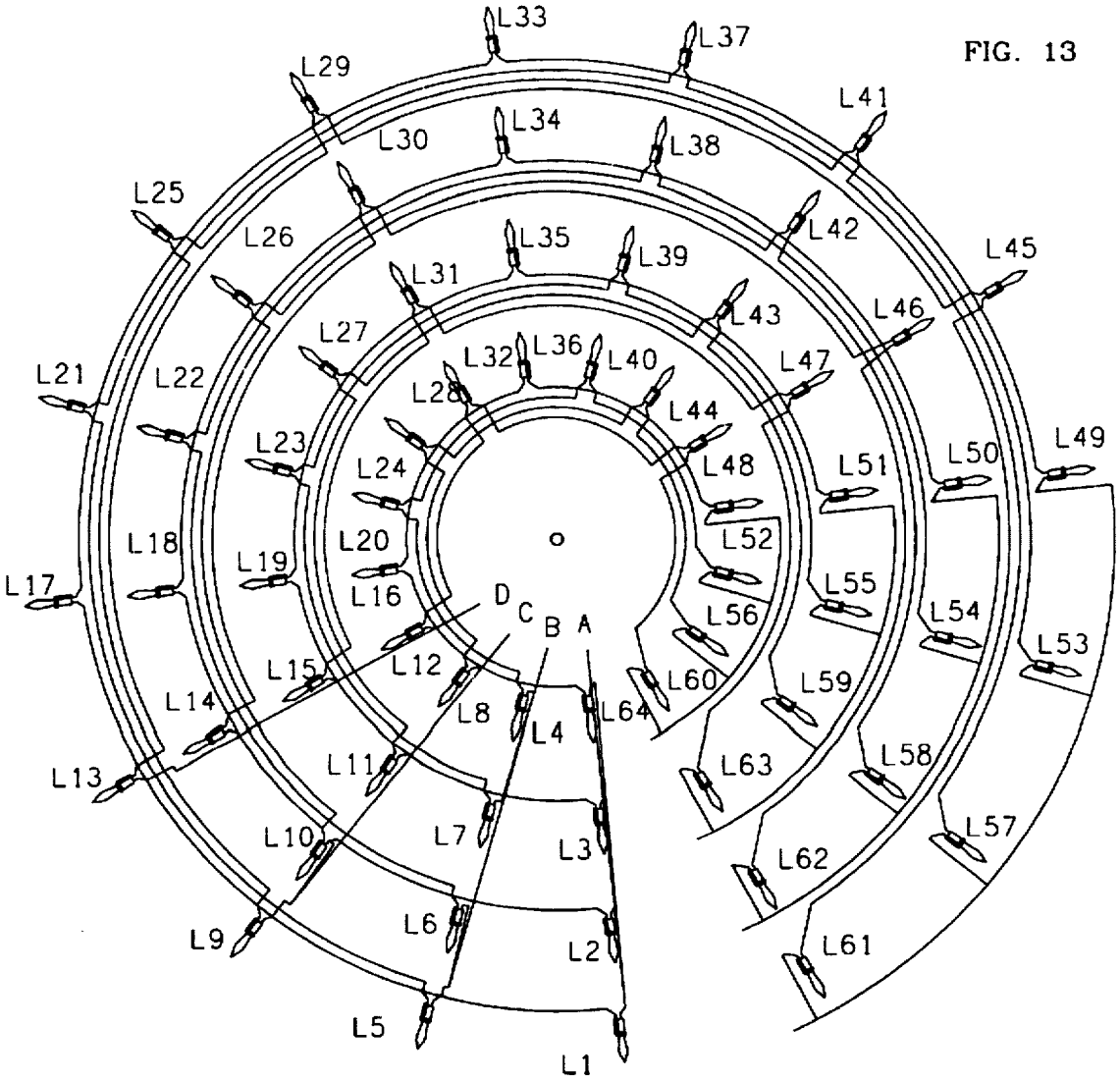
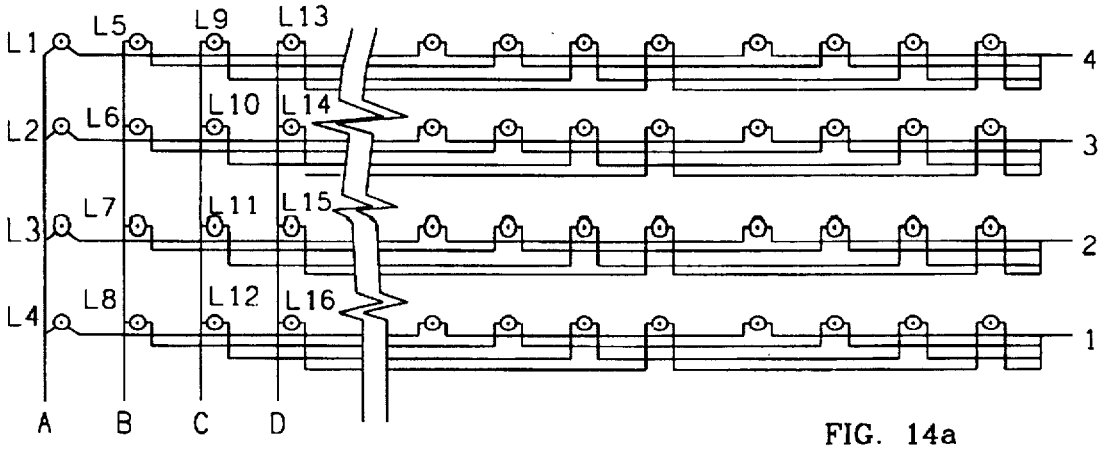
FIG. 14a

FIG. 16a
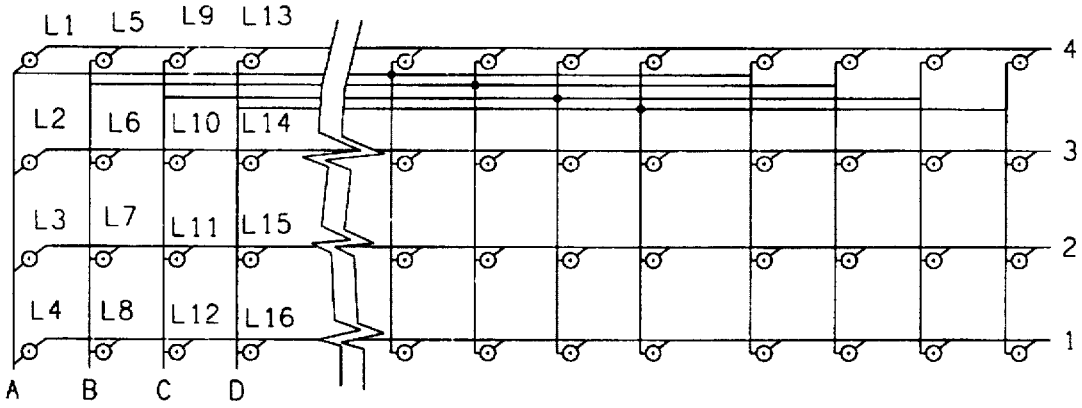
FIG. 16b
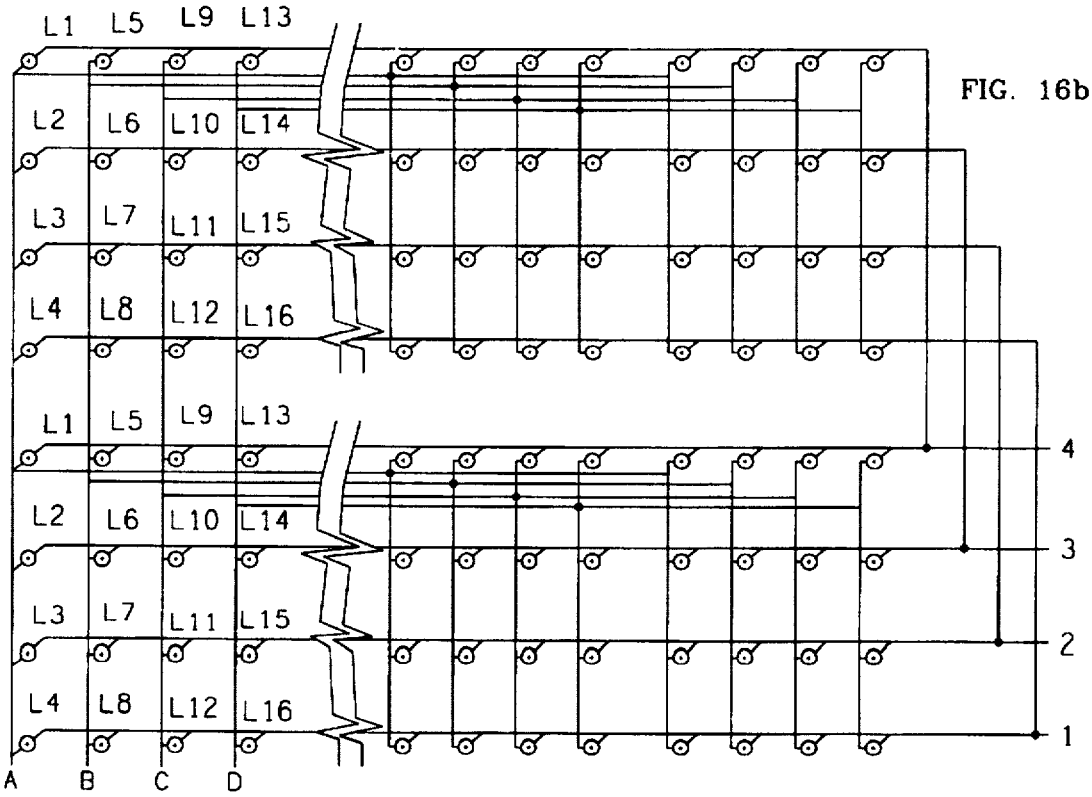
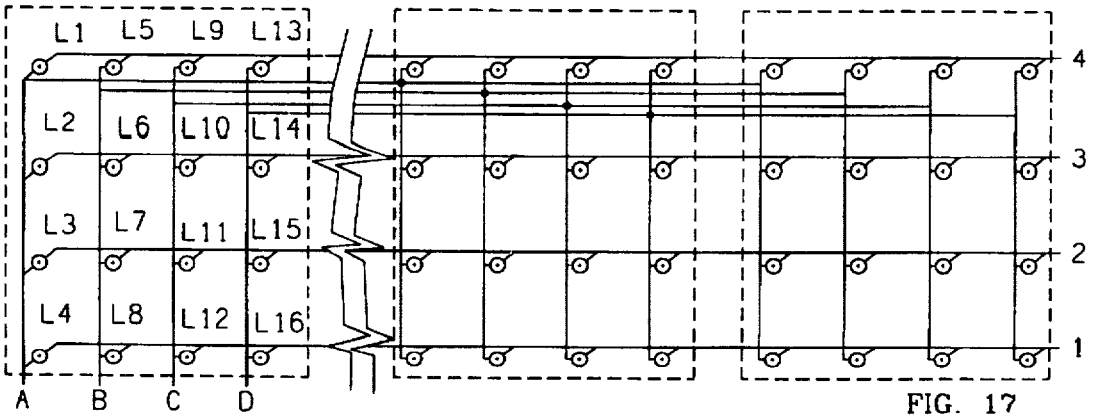
FIG. 17

FIG.23
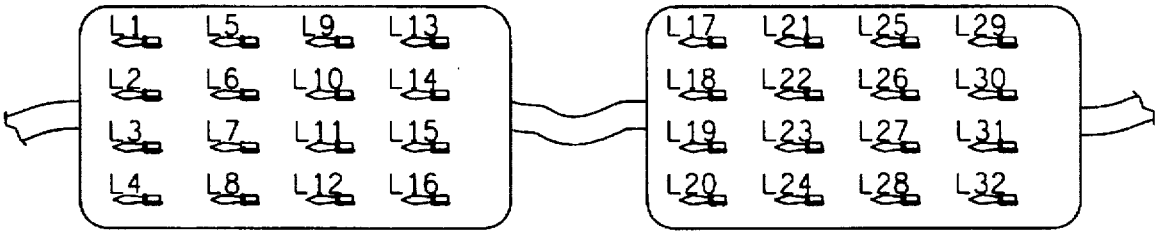
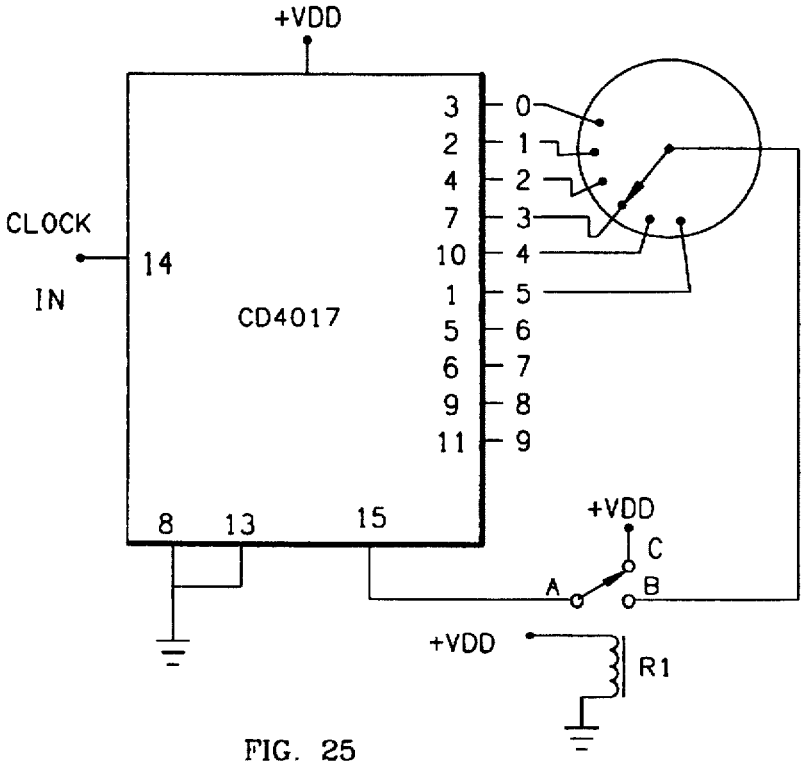
FIG. 25

MULTI-DIMENSIONAL CONTROL OF ARRAYED LIGHTS TO PRODUCE SYNCHRONIZED DYNAMIC DECORATIVE PATTERNS OF DISPLAY, PARTICULARLY FOR FESTIVAL AND CHRISTMAS LIGHTS

BACKGROUND OF THE INVENTION

1. Field of the Invention

The present invention generally concerns light displays, and the wired interconnection of light displays to one or more light display controllers.

The present invention particularly concerns regular geometric arrays of lights where individual lights are selectively energized for illumination by electrical connection between multiple, typically two, independently-controlled buses, the multi-dimensional control particularly producing illumination display patterns (other than text) that are primarily for purposes of visual stimulation and entertainment, particularly for festival and/or Christmas lights.

The present invention further particularly concerns the (i) lockstep synchronization, at a (ii) variably predetermined rate, of sequencing through successive displays presented by separate, but related, groups of decorative lights.

2. Description of the Prior Art

A major application and embodiment of the present invention will be seen to be as multiple arrays each of a large number of typically small typically incandescent lamps, such as are normally associated with festival and/or Christmas lights, and as are more particularly commonly known as Christmas tree lights.

In their basic form, Christmas tree lights commonly come in strings of anywhere from 35 to 150 and more individual lights. The entire light string is made from very little and mostly inexpensive material: typically glass, plastic and copper. The light strings are typically made by semi-automated machine processes, most commonly in developing or even undeveloped countries. In larger string sizes the retail cost to an American consumer is typically only a few cents (1–3¢) U.S. per light, circa 1995.

Nonetheless to the typically inexpensive construction of festival or Christmas lights, the lights are typically presently (circa 1996) provided with transistorized light controllers that typically serve to produce diverse display patterns. The controllers typically serve to switch power to a typically large number of lights M located along and upon several separate power distribution buses N, the number N of buses typically being less numerous than are the number M of lights. Typically M is greater than fifty (50), N is equal to or greater than four (4), and M divided by N (M/N) is an integer number.

The illumination control typically causes the lights (i) to "chase" each other in each of two directions along a string of such lights, (ii) to flash all together or in sections (which sections may be related to colors), and/or (iii) to perform all such selective illuminations rates that are typically variable in accordance with, commonly, the manual adjustment of, typically, a rheostat or potentiometer.

The light displays of separate groups of lights typically neither start at the same time, nor proceed at the same rate, nor proceed in lockstep. Because the displays of each separate group of the decorative lights are seldom related to the displays of other groups, this lack of coordination has typically not heretofore presented any significant limitation.

When the lights are geometrically arrayed, as is taught in U.S. Pat. No. 5,245,519 for MULTI-BRANCHED CHRISTMAS LIGHTS to the selfsame Renato Openiano who is the inventor of the present invention, then still further display effects are possible. Lights arrayed as the tips of a six-pointed star may, for example, flash in rotations both clockwise and counter-clockwise. They may flash at opposite points, and at opposite points in rotation. All lights may flash at the same time. The rates of all effects may be varied, and may vary progressively automatically.

Because the lights of each separate group of decorative lights sequence under an independent, rate-controllable, light controller for that group, the successive light displays between different individual groups of lights neither are, nor are intended to be, (i) started at the same time, (ii) progressing at the same or at related rates, or (iii) proceeding in lockstep. The lights of multiple groups are, however, potentially–at least upon the full discharge after some hours leakage of an internal (timing) capacitor in the display controller—started at the same time. This is accomplished simply by applying power to each of several groups all at the same time.

Because of their added, and arguably more interesting, display modes, arrayed Christmas tree lights such as are taught in said U.S. Pat. No. 5,245,519 have widely commanded in the U.S. retail market (circa 1995) a premium sales price that has been as much as ten times (×10) the price of a simple light string containing the same number of individual lights. Innovation has thus sufficed to add commercial value to what is otherwise essentially a commodity product. The present invention will be seen to be similarly directed; attempting to produce new and useful light displays incorporating significant advantages from what are essentially low-cost pre-existing components.

Electrically, strings or other arrays of Christmas-type lights have typically been connected as a number of separate buses, or wires, that are selectively energized at the point of, from, and by action of a light controller. Each individual light is connected between an energizing bus, or wire, and a common ground. The light is either turned on or off—as are all others identically connected—in accordance that the bus, or wire, is energized.

Importantly for comparison to the present invention, the electrical connection to ground is fixed and unchanging, and is not switched.

Meanwhile, an entirely different class of display lighting exists. This class is capable of immensely sophisticated displays, and even permits the communication of information in the form of text (which may be scrolled) or pictures. This class of display lighting is commonly called marquee style lighting. The occasional use of this style of lighting for display and entertainment, as opposed to communications, purposes is typified by the arguably gaudy signboards of Las Vegas, Nevada, U.S.A.

In marquee style lighting each light is individually controlled in illumination, commonly by a computer controller or like device of considerable sophistication and cost. The reason that each individual light is normally so individually controlled is straightforward: particularly in the rendition of roman alphabet letters (as are exemplified by this very text as now appears in front of the reader's eyes), it is not possible to define the individual lights to be illuminated, and those not that are not to be illuminated, by attempting the formation and presentation of a alphabet letter by selective energization transpiring along only (the lines of) axis lines, or at the intersection of only two intersecting axis.

Individual light control is costly. The numerous power gating elements, having a one-to-one correspondence with the controlled lights, contribute significant cost—although improved integration and cost of power electronics is reducing this cost yearly. The other major cost of marquee lighting is the necessity to run a dedicated "wire" interconnection to each controlled light. Such dedicated electrical connection consumes a large amount of material, and is very labor intensive to construct (at least over any sizable area, and a large number of lights). This is why the very largest Las Vegas illuminated signboards typically cost millions of dollars U.S. (circa 1995).

Nonetheless that two-axis control of lights in a grid array is not useful for full marquee lighting, it is the premise of the present invention that a similar manner of controlling arrayed lights—which need not even be so arrayed in a rectilinear grid—can be very useful for decorative purposes, especially should it be accomplishable economically. One type of light display that would seemingly so benefit would be festival, or Christmas, light decorations and displays, or the equivalent decorations and displays for other religious faiths and/or for other events.

SUMMARY OF THE INVENTION

The present invention contemplates separately selectively simultaneously controlling both (i) voltage and (ii) ground signals in order to selectively energize large numbers of arrayed lights, therein to produce dynamic decorative patterns of display such as are particularly suitable for festival and/or Christmas lights. The lights may be arrayed either two- and three-dimensionally, and the display patterns produced may be either two- or three-dimensional.

The present invention further, separately and severally, contemplates controlling separate groups of decorative lights to commence sequenced displays (i) at the same time, (ii) at variably predetermined rates that are predetermined so as to be in an arbitrary relationship, including but not limited to an equal relationship, with the rates of sequencing of other, separate, light displays. For example, the lights of one or more groups may sequence each group through a set number of successive displays at a set rate while other, synchronized, groups sequence at one and one half (×1½), twice (×2), or even three times (×3) this rate. If the rates are equal (1:1) then the displays of each of two or more groups of lights (which groups need not be coextensive in size) proceed in lockstep synchronization.

The separate, but related, sequencing of separate groups of lights may particularly be, but is not limited to, the (2-D or 3-D) arrayed lights of the present invention that are selectively illuminated by simultaneous connection to both (i) voltage and (ii) ground. Particularly when lights that are arrayed and energized in accordance with the present invention are also (i) synchronized, and (ii) sequenced at related rate(s) or in lockstep, also in accordance with the present invention, then massively sized and universally coordinated light displays consisting of many thousands or even millions of individual lights occupying very large areas or volumes (i.e., many $m^2$ or $m^3$) are easily realizable.

Nonetheless that the light displays created by use of the present invention in both its aspects may be both very large and, it is maintained, highly visually interesting, these displays are easily assembled from identical sections, or groups of lights, by amateurs, and particularly by homeowners or other persons wishing to construct such displays.

1. Nature and Effect of Light Energization Control in Accordance with the Present Invention Light energization control in accordance with the present invention is distinguished for producing sophisticated display patterns in arrayed lights (of any size) without incurring the expense of either the separate wired connection to, or the separate control of, each individual light. Instead, the arrayed lights are wired in much the same manner, and roughly as inexpensively, as are common "Christmas tree" light strings—save only that each of the (i) voltage and (ii) ground distributions are split into several, typically four or more, separate buses, and these separate buses are then individually controlled. This fundamental principle of the present invention—that arrayed lights should be selectively energized between multiple voltage and multiple ground distribution buses—is not affected in that (i) the lights, and (ii) the busses, may wired either in series, or, alternatively, in parallel.

An independent control of (i) the several voltage buses and (ii) the several ground buses determines which ones of the individual lights will be at any one time illuminated, and thus the overall display and sequence of displays. Typically the lights are arrayed either (i) two-dimensionally—typically in clusters, in regular rectangular grids, in circles, or radially—or else (ii) three-dimensionally—typically in cubic, spherical, pyramidal and other regular geometric volumes.

Typical illumination display effects realized in the two-dimensional arrays are analogous to those displays previously realized on one-dimensional light strings (or on such strings as are held in patterns, such as in the shape of a star) save only that complete lines of typically several lights, as opposed to individual lights, are commonly selectively illuminated. Certain particular illumination displays commonly realized include (i) "chasing" modes where lights successively illuminate along successive axis such as, for example, in sideways or rotational directions, (ii) "burst" modes where the lights successively illuminate, for example, upwards, downwards, in either direction around a circle, or inward or outward, (iii) contra-positioned light illuminations at points and in areas that are symmetrically opposite along one or more points, axis or planes of symmetry, (iv) successive illuminations along diagonals, radiuses, and concentric circles, and (v) combinations of the above.

Display modes realized in three-dimensional arrays are similar save that the selective illuminations are typically of entire planes (i.e, matrixes), as opposed to lines, of separate lights.

It will become clearer upon study of the present invention that any decorative effect desired, and typically many different and interesting decorative effects in succession, may be obtained based upon the particular choice of (i) physical locations, and (ii) multi-dimensional electrical interconnection, of the arrayed lights. It will further become clear that the principles of the present invention are applicable to both two-dimensional and three-dimensional arrays of lights. Two-dimensional arrays of string lights may be, for example, pre-mounted in regular geometric patterns to the planar surfaces of semi-rigid materials, such as rolled sheet plastic. Three-dimensional arrays of sting lights are commonly strung in free space in regular lattice patterns between walls, poles, or trees.

With enough lights and creative artistry in programming the sequence of illuminations, the illumination displays produced can be quite striking and interesting in both two and three dimensions. (Although the arrayed lights are controllable so as to produce many, and sophisticated, decorative effects, it should be understood that they are not intended to, and cannot, convey information such as, for example, English text.) Moreover, the displays can be massive, such as a million plus light three-dimensional geometric "forest" of lights having and presenting a tunnel through which a car may be driven.

Much facilitating the creation of very large two- and three-dimensional light displays is the capability in accordance with the present invention to synchronize both the (i) initiation, and (ii) relative timing, of multiple sequential light displays (light arrays). A preferred automatic zeroing (i.e., reset) and selectable counter circuit in accordance with the present invention permits any desired number of light arrays to be initiated all at the same time by the simple expedient of applying primary power to all arrays in common. Moreover, the sequential displays of each array may thereafter be maintained in lock step or, in slightly more advanced versions of the invention (nonetheless using the same inexpensive automatic zeroing and selectable counter circuit), some arrays may be made to cycle step at multiples—e.g. ⅔, or 2, or 3 times—of the speed of other arrays.

Nonetheless that the composite displays produced can become extremely large and complex in accordance with the (i) artistic location, (ii) massive replications, (iii) three-dimensional location, (iv) start coordination, and/or (v) variable step time synchronization relationships between the display sequences, of many individual arrays, everything in such large and complex displays is completely realizable from inexpensive standard arrays and accompanying controllers. Each array its accompanying controller is typically packed and sold in a box. Accordingly, an individual or family may augment, and may alter, a light display presentation from year to year by the simple expedient of adding to, and/or re-connecting, an existing stock of modular arrays. (For this reason of "building block" commonality, it is intended that the certain sizes (e.g., 6×6×6) and certain sequences (e.g., successively illuminated "planes" from left to right, from right to left, from bottom to top, from top to bottom, etc., in a cubical array) of light arrays should become "standards", and should be compatible from year to year.)

2. Construction of a Light Array in Accordance with the Present Invention

The present invention can thus be considered to be embodied in an electrical system that is electrically connected between (i) a system voltage and (ii) a system ground in order to produce decorative patterns of display in a multiplicity of lights. The system includes a multiplicity of arrayed lights each of which emits illumination when electrically energized between (i) the system voltage and (ii) the system ground.

A number of voltage distribution buses, typically four or more such buses, are each connected to an associated group of the arrayed lights. Each bus is selectively electrically connected to the system voltage so as to carry this system voltage to the arrayed lights of the associated group.

A number of ground buses, typically four or more such buses, are also each connected to an associated group of the arrayed lights. Each group is selectively electrically connected to the system ground so as to carry the system ground to the arrayed lights of the group.

Those groups of the arrayed lights connected to the voltage buses, and those groups connected to the ground buses, are typically not only not the selfsame identical groups, but are typically groups having a minimum overlap between group members and are, indeed, more typically orthogonal groups, or sets. This means simply that each group of each type (i.e., voltage or ground) most typically contains but one single light from each of the several groups of the other type.

A light controller (i) selectively electrically connects one or more of the several voltage buses to the system voltage, and also (ii) selectively electrically connects one or more of the several ground buses to the system ground. Electrically, this light controller is preferably constructed similarly to a simple Christmas tree light controller, or other similar-type light controller. It is simply made "double-ended" so that it (separately) switches—through (separate) triacs or silicon controlled rectifiers (SCR's) or power transistors or like standard components—both (i) system voltage, and (ii) system ground, each to a respective distribution bus.

By this operation those individual ones of all the multiplicity of lights that are electrically connected at any one time between both an instantaneous system-voltage-energized one of the several voltage busses, and also to an instantaneous system-ground-connected one of the several ground buses, will emit illumination. Remaining individual ones of the multiplicity of lights not then instantaneously so energized and connected will not then illuminate. Overall, selected ones of the multiplicity of arrayed lights are thus illuminated at each of successive times, producing a display. Each instantaneous display is preferably in a pattern, such as a line (in two dimensions) or a plane (in three dimensions) of illuminated lights. Moreover, the successive illuminations as occur upon successive times are typically spatially (as well as temporally) related, producing a coherent and pleasing display, and display sequence.

The multiplicity of lights are commonly circularly arrayed, or arrayed in a two-dimensional matrix.

Each of the several voltage distribution buses may carry system voltage to the arrayed lights of the associated group either in electrical series, or in electrical parallel. Likewise, each of the several ground buses may carry system ground to the arrayed lights of the associated group either in electrical series, or in electrical parallel.

The light controller may selectively successively electrically connecting one or more of the several voltage buses to a system voltage (energizing this one or more of the several voltage buses from the system voltage), and may also selectively successively electrically connecting one or more of the several ground buses to a system ground, in many different ways. At least the following four combinations are common.

As a first case, the light controller can momentarily connect all the ground buses to the system ground, and, concurrently, all the voltage buses to the system voltage. This lights all lights.

As a second case, the light controller can momentarily connect all the ground buses to the system ground, and, concurrently, can successively connect successive ones of several voltage buses to the system voltage. This causes successive groups of lights to illuminate which groups correspond to those lights that are connected to each of the several voltage buses.

As a third case, and as the opposite of the second case, the light controller can momentarily successively connects successive ones of all the ground buses to the system ground, while, concurrently, connecting all the voltage buses to the system voltage. This again causes successive groups of lights to illuminate, which groups now correspond to those lights that are connected to each of the several ground buses.

As a fourth case, the light controller can momentarily successively connect successive ones of all the ground buses to the system ground, and, concurrently, successive ones of the voltage buses to the system voltage. In this case individual lights will successively illuminate.

Depending upon sequencing, phasing, timing, etc., many sophisticated display patterns are possible. Two-dimensional (area) displays are generally more interesting to humans than are one-dimensional (line) displays, and three-dimensional displays are generally more interesting still. For maximum versatility of display, the light controller can incorporate a microprocessor operating under microprogram control.

Particularly when configured as Christmas lights, the arrayed lights are normally regularly arrayed, and/or emit light in a number of colors.

The many lights are typically held arrayed on one or more substantially planar substrates, which substrates are typically either circular or rectangular in shape.

3. Co-ordination of the Displays of Several Individual Groups, or Arrays, of Lights Finally, it is generally possible to co-ordinate the progressive displays of a great number of individual light arrays in accordance with the present invention by the simple expedient of plugging them all into common power outlets—normally a.c. line power outlets on a multi-plug jack power strip or the like—and then turning on the (a.c.) power to all arrayed lights in common at the same time. In one preferred embodiment of a light controller in accordance with the present invention, each array will (i) start, and (ii) sequence in equal time. The displays controlled by each may thus be related over an arbitrarily large area, or volume. In simple terms, the light arrays of the present invention are infinitely scalable, and are coordinated in their presentations when so scaled.

In another preferred embodiment a light controller of the present invention is externally plug-connected, or jumpered, to other light controllers. One (only) light controller is switch designated to be a "master". All others are oppositely designated by an alternative setting of the same switch to be "slaves". Each array will (i) start at the same time, and will (ii) sequence in lockstep at a predetermined rate established by the master.

In still yet another preferred embodiment a light controller of the present invention, each controller is programmed (i.e., timed, or clocked) relative to the same a.c. waveform of the input power. For example, one array can be made to step from one display to the next at a base cycle period, a next array at half this period (i.e., twice as fast), and a third array at half this period yet again (i.e., four times the base cycle speed).

All such synchronized, but variably timed, displays are useful in simulating phenomena such as acceleration over large areas or volumes.

These and other aspects and attributes of the present invention will become increasingly clear upon reference to the following drawings and accompanying specification.

BRIEF DESCRIPTION OF THE DRAWINGS

FIG. 13 is a combination electrical and mechanical schematic diagram showing a representative second preferred embodiment of a multi-dimensionally controlled arrayed lights in accordance with the present invention.

FIG. 14*a* is a wiring diagram for a first variant, series, electrical connection of one copy of the second preferred embodiment of the multi-dimensionally controlled arrayed lights in accordance with the present invention previously seen in FIG. 13.

FIG. 16*a* is a wiring diagram for a second variant, parallel, electrical connection of one copy of the second preferred embodiment of the multi-dimensionally controlled arrayed lights in accordance with the present invention previously seen in FIG. 13.

FIG. 16*b* is a wiring diagram for the second variant, parallel, electrical connection of two copies of the second preferred embodiment of the multi-dimensionally controlled arrayed lights in accordance with the present invention previously seen in FIGS. 13 and 16*a*.

FIG. 17 is a wiring diagram for a second variant, parallel, electrical connection of the first preferred embodiment of the multi-dimensionally controlled arrayed lights in accordance with the present invention previously seen in FIG. 1.

FIG. 23 is a mechanical schematic diagram showing a first embodiment, planar, mounting of the first preferred embodiment of a multi-dimensionally controlled arrayed lights in accordance with the present invention previously seen in FIG. 1.

FIG. 25 is a schematic diagram of a first preferred embodiment of a sequencing counter with automatic reset means in accordance with the present invention which, when combined with a standard sequential light controller adapted to the purposes of the present invention (as shown in FIG. 1), permits of (i) start coordination between multiple separate arrays of lights, and (ii) variable related sequence (cycle) speeds.

DESCRIPTION OF THE PREFERRED EMBODIMENT

Figure 1:
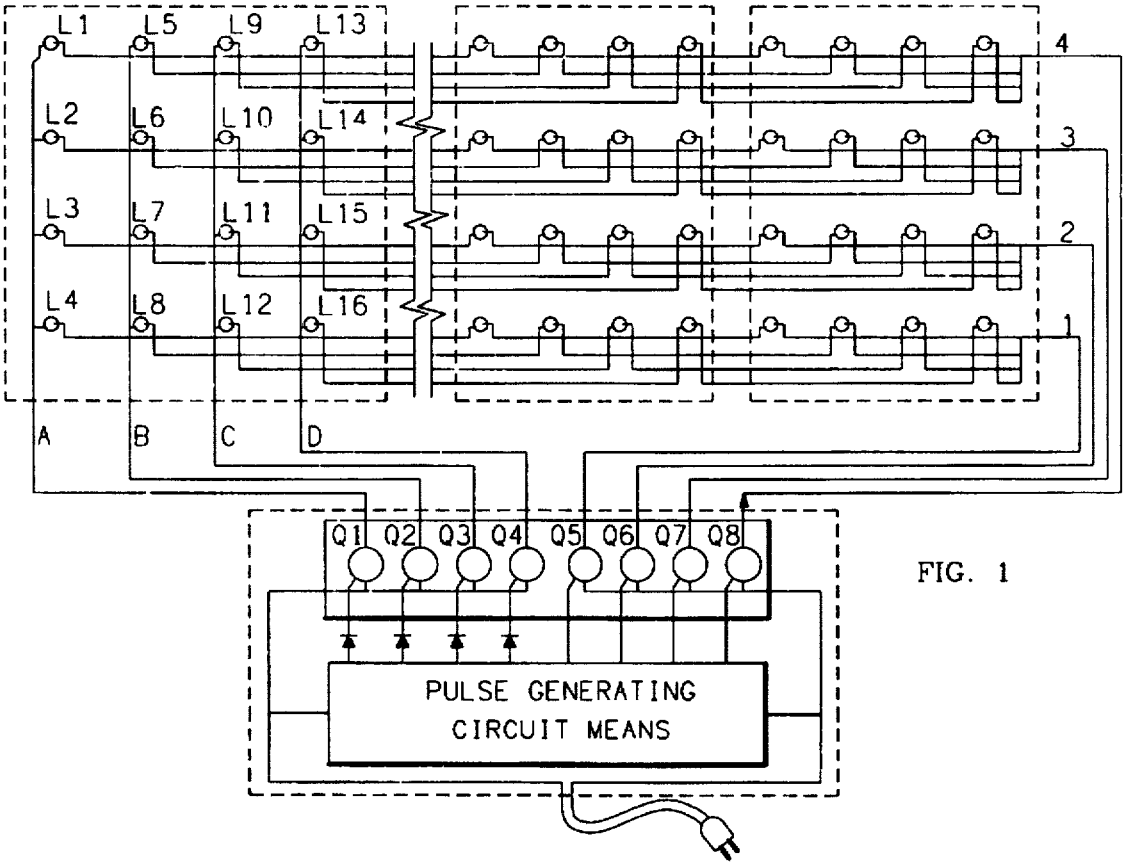
FIG. 1 is an electrical schematic diagram showing a representative first preferred embodiment of a multi-dimensionally controlled arrayed lights in accordance with the present invention.

An electrical schematic diagram showing a representative first preferred embodiment of the multi-dimensionally controlled arrayed lights in accordance with the present invention is shown in FIG. 1. The lights L are shown, by example, to be electrically arrayed in N sections of 4×4, or 16, lights each section. It will be understood by a practitioner of the electrical arts that the physical location(s) of the lights need have nothing to do with their electrical connections diagrammed in FIG. 1. It will also be understood the size of the array need not be 4×4, or that the array need not be of equal dimension in each of two axis (i.e., square). However, for purposes of convenience, it may be considered that the lights L are also physically arrayed in 4×4 square of 16 total lights (per array section) as is, for example, illustrated in the lighting harness shown in FIG. 23.

Returning to FIG. 1, the lights L of a first, representative, section are labeled L1–L16. Along each of four first-direction, Y, axis the lights L1–L4, L5–L8, L9–L12, and L13–L16 are respectively wired in parallel to a respective one of four first-type buses A,B,C,D. Along each of four second-direction, X, axis the lights (L1,L5,L9,L13), (L2,L6, L10,L14), (L3,L7,L11,L15), and (L4,L8,L12,L16) are respectively wired in parallel to a respective one of four second-type buses 1,2,3,4.

Each of the four first-type buses A,B,C,D, may be either (i) a voltage or (ii) a ground bus. Likewise, each of the four second-type buses 1,2,3,4 is then the other, remaining, type of either (i) a ground, or (ii) a voltage, bus.

Each of the four first-type buses A,B,C,D, is switched by a respective (power) switching element Q1, Q2, Q3 or Q4—which switching element may typically be any of a triac, a silicon controlled rectifier (SCR), a transistor, or other, equivalent, current switching means. A triac (which serves to switch alternating currents) is preferred (at least for large applications), and a triac is illustrated in FIG. 1.

Likewise, each of the four second-type buses 1,2,3,4 is also, independently, switched by a respective (power) switching element Q5, Q6, Q7 or Q8. These elements are again typically be any of a triac, a silicon controlled rectifier (SCR), a transistor, or other, equivalent, current switching means. They are preferably triac, and are also preferably the same type of switching elements Q1, Q2, Q3 or Q4.

Control of the current gating in each of the power switching elements Q1–Q8 arises from a PULSE GENERATING CIRCUIT MEANS. This PULSE GENERATING CIRCUIT MEANS is merely a conventional light controller—such as is common for, among other applications, Christmas tree lights—expanded to have twice the normal number of control signal outputs—i.e., eight such signal outputs (as are respectively received at Q1–Q8) in FIG. 1 as opposed to four such signal outputs. The PULSE GENERATING CIRCUIT MEANS may be a simple microprocessor running a microprogram to effect the sequencing and timing of signal outputs on the (typical) eight bus lines.

The circuit embodiment of the present invention shown in FIG. 1 is only exemplary, and representative. The switched and controlled power distribution buses A–D and 1–4 can be increased, for example to A–D,E,F and 1–4,5,6. It is simply necessary to expand the size of the PULSE GENERATING CIRCUIT MEANS. Although microprocessor having sixteen and more output (bus) lines upon which the sequencing and timing of signal outputs may be controlled are relatively inexpensive (circa 1995), it might be envisioned that, for a very large N×N matrix with N>>16 that direct control of the switching elements Q1–Q8 by the microprocessor could become unwieldy. It is, or course, possible to use (i) a decoder circuit to set, and to reset, (ii) flip-flops, or latches (not shown). Both decoder circuit and flip-flops are inserted between the microprocessor and the switching elements Q1–Q8. The flip-flops are set cleared under control of the microprocessor (acting through the decode circuit) in order to hold a state that either enables, or disables, the associated switching element Q1–Q8.

Timing diagrams showing exemplary signals as may be developed in the PULSE GENERATING CIRCUIT MEANS previously seen in FIG. 1 are shown in FIGS. 2–12. The timed and sequenced signals shown are used to control the multi-dimensionally controlled arrayed lights L also previously seen in FIG. 1.

Figure 2:
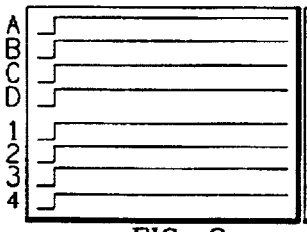
FIGS. 2–12 are each timing diagrams showing exemplary signals as may be developed in the PULSE GENERATING CIRCUIT MEANS previously seen in FIG. 1, which signals are used to control the multi-dimensionally controlled arrayed lights also previously seen in FIG. 1.

The timing diagram of FIG. 2 produces, after the step function (at arbitrary time $t_o$) illumination of all lights.

Figure 3:
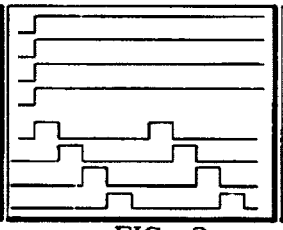
Figure 4:
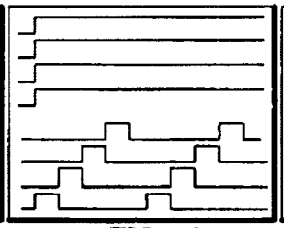

The timing diagram of FIG. 3 produces an upward and outward display motion on the arrayed lights L of FIG. 1. Conversely, the timing diagram of FIG. 4 produces an downward and inward display motion on the arrayed lights L of FIG. 1.

Figure 5:
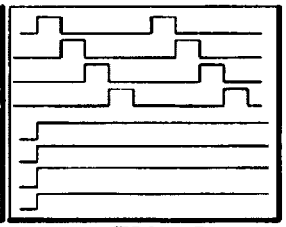
Figure 6:
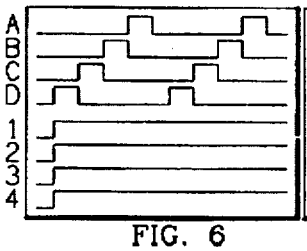

The timing diagram of FIG. 5 produces a right, or clockwise, display motion on the arrayed lights L of FIG. 1. Conversely, the timing diagram of FIG. 6 produces a left, or counter-clockwise, display motion on the arrayed lights L of FIG. 1.

Figure 7:
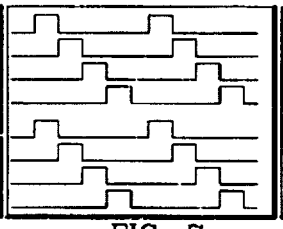
Figure 8:
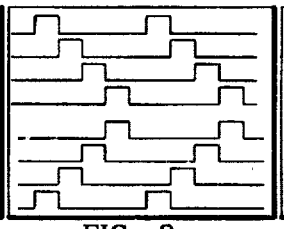

The timing diagram of FIG. 7 produces a right diagonal, or "/", display motion on the arrayed lights L of FIG. 1. Conversely, the timing diagram of FIG. 8 produces a left diagonal, or back slash, or "\", display motion on the arrayed lights L of FIG. 1.

Figure 9:
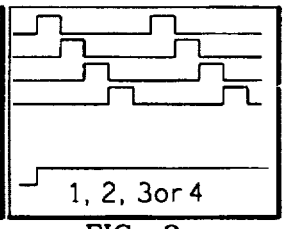
Figure 10:
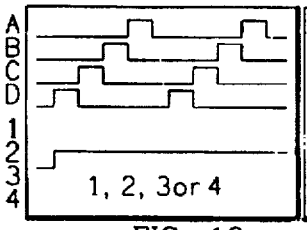

The timing diagram of FIG. 9 causes a single level of lights to successively illuminate in a right, or clockwise, direction on the arrayed lights L of FIG. 1. Conversely, the timing diagram of FIG. 10 causes a single level of lights to successively illuminate in a left, or counter-clockwise, direction on the arrayed lights L of FIG. 1.

Figure 11:
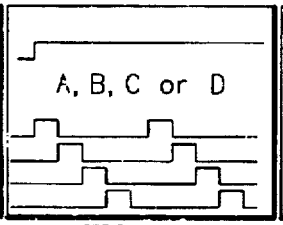
Figure 12:
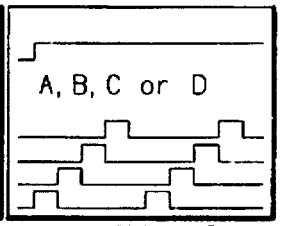

The timing diagram of FIG. 11 causes a single row, or circle, of lights to successively illuminate in an upward, or outward, direction on the arrayed lights L of FIG. 1. Conversely, the timing diagram of FIG. 10 causes a single row, or circle, of lights to successively illuminate in a downward, or inward, direction on the arrayed lights L of FIG. 1.

Clearly the many different timed and sequenced signals of the timing diagrams of FIGS. 2–12 are exemplary only. Many different timed and sequenced signals may be developed in the PULSE GENERATING CIRCUIT MEANS (previously seen in FIG. 1) in order to control the lights L multi-dimensionally to produce interesting, entertaining and aesthetically pleasing patterns of illumination.

A combination electrical and mechanical schematic diagram of a representative second preferred embodiment of a multi-dimensionally controlled arrayed lights in accordance with the present invention is shown in FIG. 13. There are still four first-type buses A,B,C,D and four second-type buses 1,2,3,4. Clearly the PULSE GENERATING CIRCUIT MEANS previously seen in FIG. 1, and the control timing and sequencing previously seen in the timing diagrams of FIGS. 2–12 may still be used. Now, however, more lights—lights L1–L64—are connected. The illustrated connection—which is but one of the circular types—is efficacious to produce interesting patterns with only but straightforward control of the type diagrammed in FIGS. 2–12.

Figure 14B:
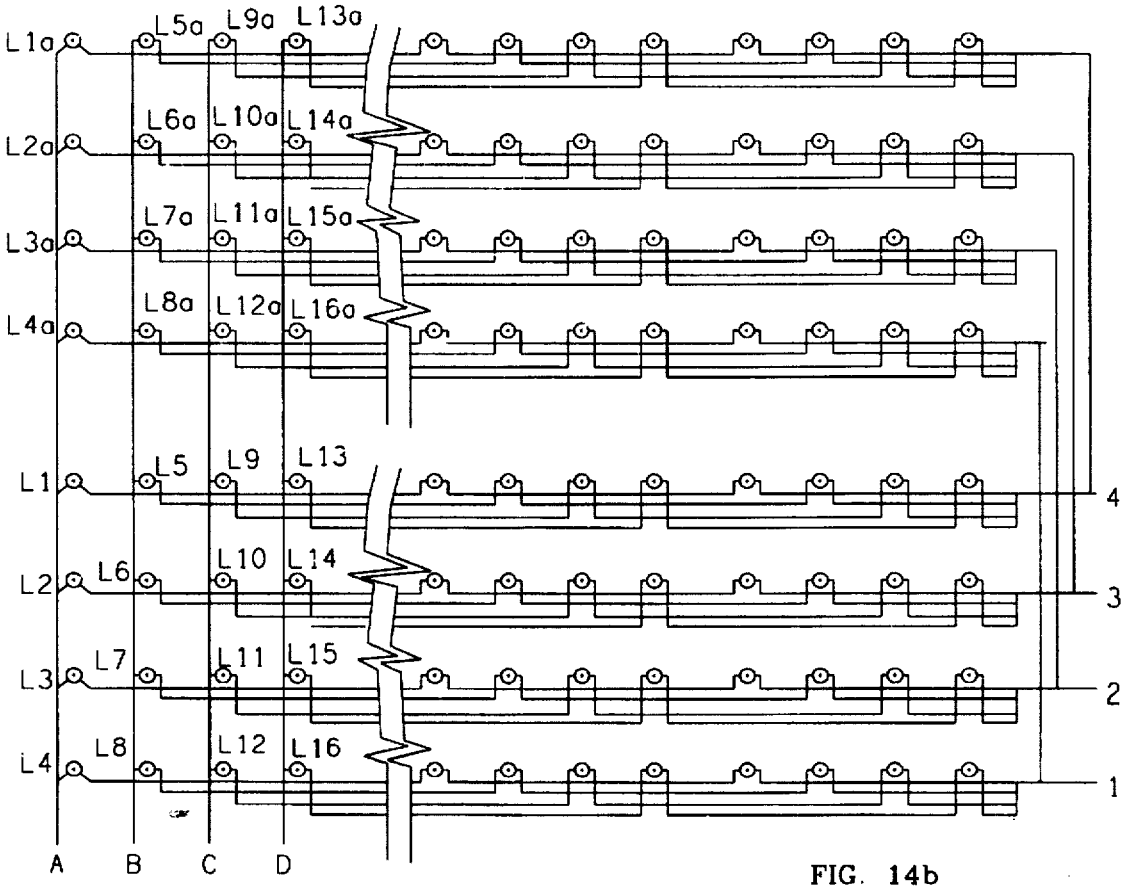
FIG. 14*b* is a wiring diagram for the first variant, series, electrical connection of two copies of the second preferred embodiment of the multi-dimensionally controlled arrayed lights in accordance with the present invention previously seen in FIGS. 13 and 14*a*.

A wiring diagram for a first variant, series, electrical connection of (one copy of) the second preferred embodiment (previously seen in FIG. 13) of the multi-dimensionally controlled arrayed lights in accordance with the present invention is shown in FIG. 14*a*. A wiring diagram for this same first variant, series, electrical connection—now of two copies of the second preferred embodiment of the multi-dimensionally controlled arrayed lights in accordance with the present invention previously seen in FIGS. 13 and 14*a*—is shown in FIG. 14*b*. The two copies of the (second preferred embodiment of the) array have nothing to do with the synchronization between separate arrays, as will be discussed in conjunction with FIG. 24. The showing of FIG. 14*a* is simply that series electrical connection is expandable to any array size, and for plural arrays in series.

Figure 15:
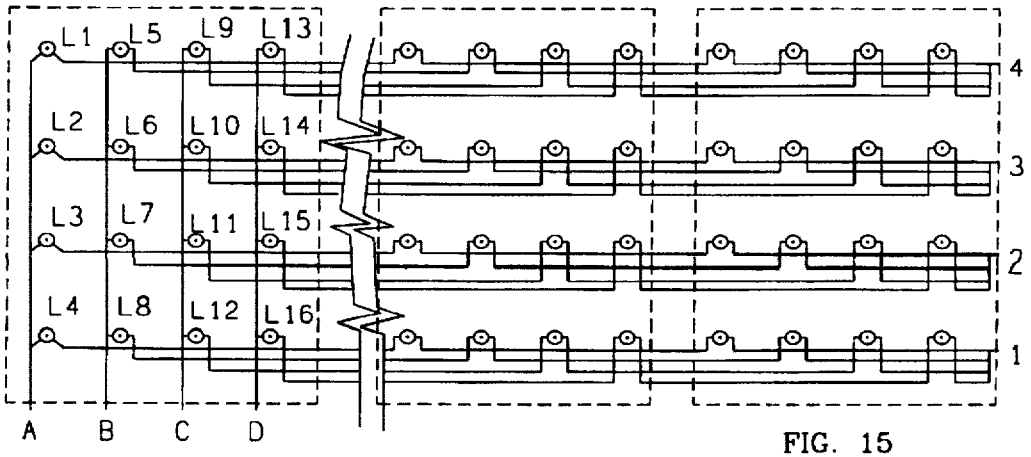
FIG. 15 is a wiring diagram for a first variant, series, electrical connection of (one copy of) the first preferred embodiment of the multi-dimensionally controlled arrayed lights in accordance with the present invention previously seen in FIG. 1.
Figure 18:
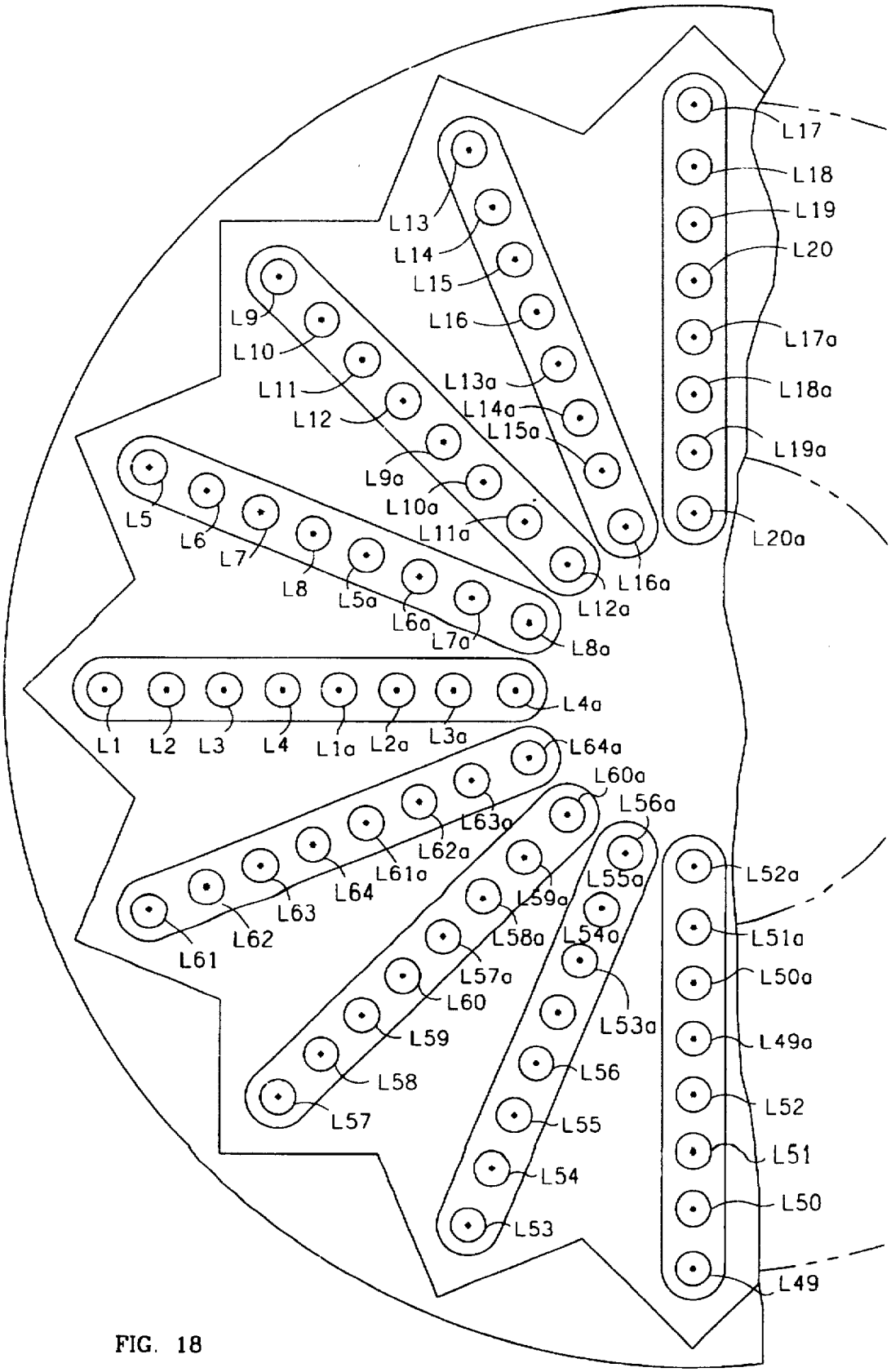
FIGS. 18–22 are mechanical schematic diagrams showing various variant mountings of the second preferred embodiment of a multi-dimensionally controlled arrayed lights in accordance with the present invention as was previously seen in FIG. 13; the individual lights identified to FIGS. 19 and 20 are particularly effective to create interesting displays.
Figure 19:
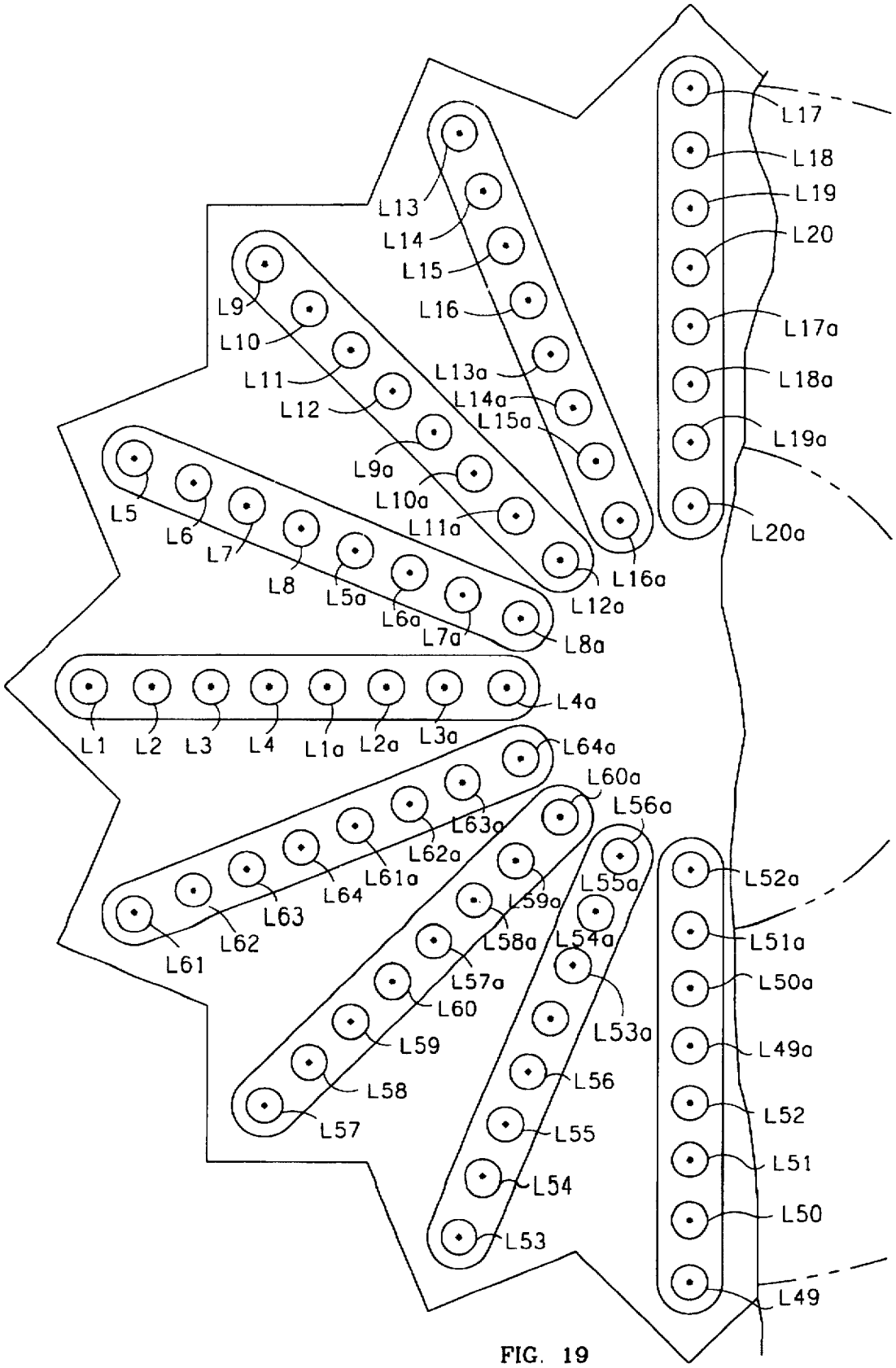
Figure 20:
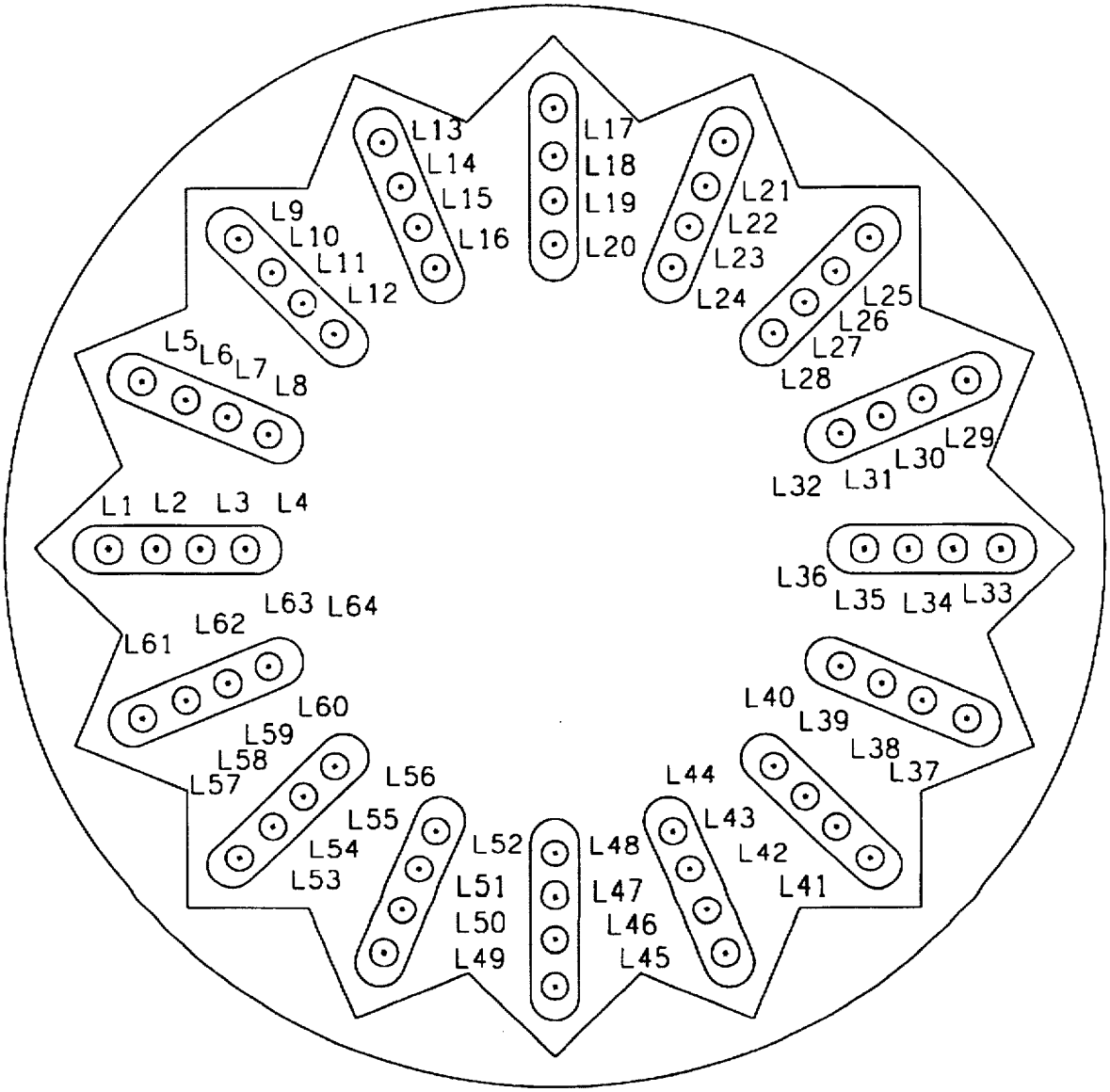
Figure 21:
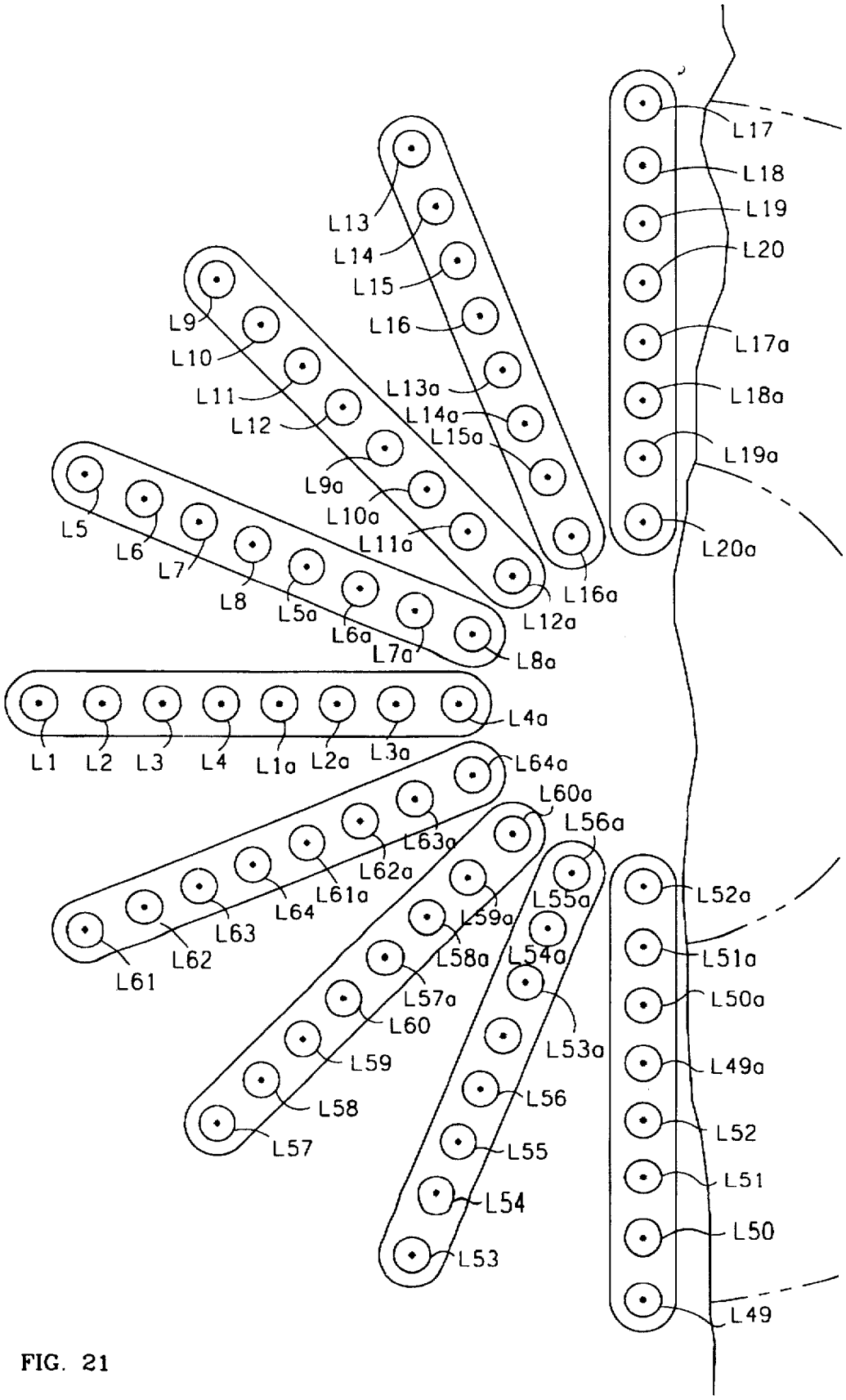
Figure 22:
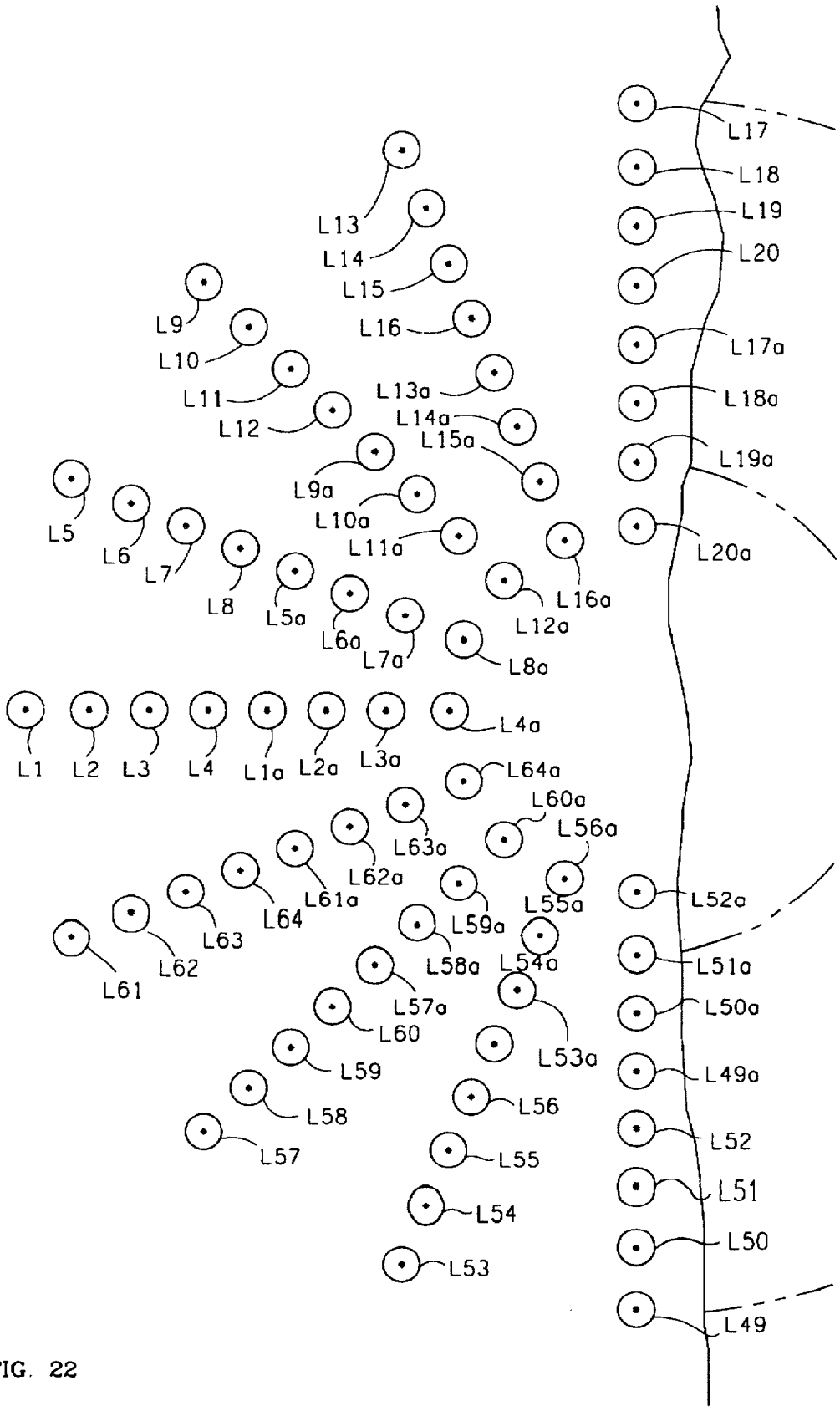

Similarly, a wiring diagram for a first variant, series, electrical connection of the first preferred embodiment (previously seen in FIG. 1) of the multi-dimensionally controlled arrayed lights in accordance with the present invention is shown in FIG. 15.

Likewise, another, alternative, wiring diagram for a second variant, parallel, electrical connection of the second preferred embodiment (i.e., again the embodiment of FIG. 13) of the multi-dimensionally controlled arrayed lights in accordance with the present invention is shown in FIG. 16*a*. A wiring diagram for this same second variant, parallel, electrical connection—now of two copies of the second preferred embodiment of the multi-dimensionally controlled arrayed lights in accordance with the present invention previously seen in FIGS. 1 and 16*a*—is shown in FIG. 16*b*. The two copies of the (second preferred embodiment of the) array again (as in FIG. 14*b*) have nothing to do with the synchronization between separate arrays, as will be discussed in conjunction with FIG. 24. The showing of FIG. 16*a* is simply that parallel electrical connection is expandable to any array size, and for plural arrays in parallel.

Finally, another a wiring diagram for a second variant, parallel, electrical connection of the first preferred embodiment (i.e., again the embodiment of FIG. 1) of the multi-dimensionally controlled arrayed lights in accordance with the present invention is shown in FIG. 17.

The teaching of each, and all, or FIGS. 14–17 is simply that the multiple dimensional control, and multiple buses, of the present invention work well, and equivalently, regardless that the individual lights should be connected to the (multiple) buses in series or in parallel. The choice of serial or of parallel electrical connection (or of a combination of both) does not effect the principles of the present invention where electrical connection (whether in serial or in parallel) to (arrayed) individual lights is made through multiple power and multiple ground buses.

Especially in the case of small, inexpensive incandescent "Christmas tree" lights, the parallel mode of connection precludes that all lights upon the same bus (in the present invention, actually each of two buses) should extinguish when one bulb fails by open circuiting (in the vernacular, "burning out"). However, note how the failed bulb in a wire-conserving series interconnection is relatively easily located at the intersection of two un-illuminated buses, or distributions, in the arrayed lights of the present invention. It is therefore to be considered that arrayed lights in accordance with the present invention may—especially if regularly rectangularly arrayed—may be electrically interconnected in series with somewhat less inconvenience to the owner upon failure than is typical of light strings of the prior art.

This is no small point. The slightly less wire consumed in a series connection may be advantageous when the displays are very, very large (i.e., 1K arrays of 1K bulbs each, or 1M total bulbs) as is both contemplated and well supported by the present invention.

Mechanical schematic diagrams showing various variant mountings of the second preferred embodiment (i.e., the embodiment of FIG. 13) of a multi-dimensionally controlled arrayed lights in accordance with the present invention are shown in FIGS. 18–22.

Figure 24:
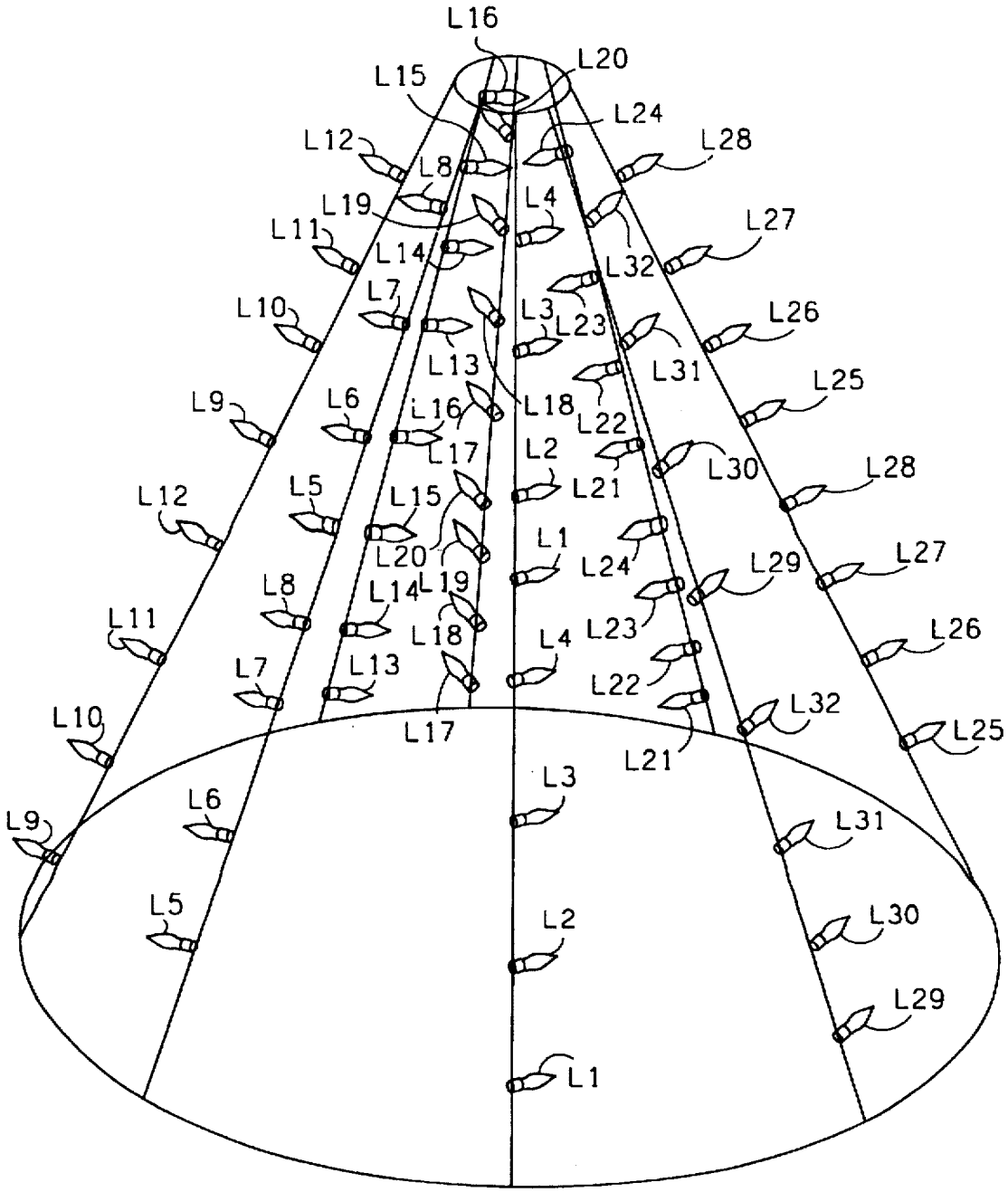
FIG. 24 is a mechanical schematic diagram showing a second embodiment, volume, arrangement of the first preferred embodiment of a multi-dimensionally controlled arrayed lights in accordance with the present invention previously seen in FIGS. 1 and 23.

A mechanical schematic diagrams showing a mounting of the first preferred embodiment (i.e., the embodiment of FIG. 1) of a multi-dimensionally controlled arrayed lights in accordance with the present invention is shown in FIG. 23. Another mechanical schematic diagram showing a second embodiment, volume, arrangement of this same first preferred embodiment of a multi-dimensionally controlled arrayed lights in accordance with the present invention (previously seen in FIGS. 1 and 23) is shown in FIG. 24. The showing of FIGS. 23 and 24 in combination is simply that the same lights controlled the same can be used to produce both two dimensional (2D) and three dimensional (3D) displays.

Synchronization and/or time-phase-related sequencing of multiple arrays of lights is another primary purpose of the present invention. Although both the (i) synchronization, and the (ii) related sequencing, realized are both particularly useful for planar (2-dimensionally) and volume (3-dimensionally) arrayed and controlled lights in accordance with the first aspect of the present invention, the contemplated display (i) synchronization and/or (ii) sequencing is also useful with, and novel of combination with, existing lights.

For example, multi-set (i) synchronization and (ii) sequencing of the multi-branched (clustered) taught in U.S. Pat. No. 5,245,519 may be realized. The Christmas lights of this patent incorporate multi-function effects such as chasing, crawling, fading, flickering, etc. The synchronization control, and sequencing, of these effects—as well as the presentations of separate massed light arrays—is a purpose of this second aspect of the present invention.

A first preferred embodiment of an electronic sequencing controller, or counter—a circuit that controls the light sequencing—in accordance with the present invention is shown in FIG. 25. The preferred circuit employs a counter and this counter acts as a sequence timer (in coordination with the clock-in signal) for the different functions.

Automatic zeroing occurs when electrical power is reconnected to such controller circuit/lights (unit). The zeroing preferably occurs by applying a positive voltage to the reset (in CD4017 I.C. this reset pin is #15) every time power is reconnected, which is every time the circuit is re-plugged to the power source.

This operation assures that each unit (controller circuit and lights) will start at the first light effect sequence of the multi-effect sequence upon re-plugging each unit to the power source, preferably 110 or 220 volts ac.

Two or more units are synchronized simply by piggy-backing their plugs (FIG. 1), or by use of a multi-outlet extension cord (FIG. 2), connect to a common power source. The principle is to apply power to each of the units at exactly the same time.

Since each of these units will start at the very start of the sequence, synchronization will happen. A clock-in signal must be the same for each of the sets to be synchronized. (For IC. CD4017, pin #14 is the clock-in pin).

The basic schematic diagram of shows a type CD4017 counter with an automatic zeroing (reset) means upon reapplication of power supply, and a continuous counter. The counter shown is wire (plug, or jumper) connected for (i) continuous mode and (ii) six (6) sequence steps. The number of count steps is determined by particular output pin connected to pin 15. For a 6 step counter, pin 1 is connected to pin 15 through rotary switch SW1. For 3 counts, pin 4 is connected to pin 15, and etc. For 2 or more digit steps counter, cascading method of the counter is used.

Relay 1 when not engaged (power off) connects +VDD to pin 15. When power is applied, for a very brief period, because of the delay in relay activation, +VDD is applied to pin 15 for the required reset.

Figure 26:
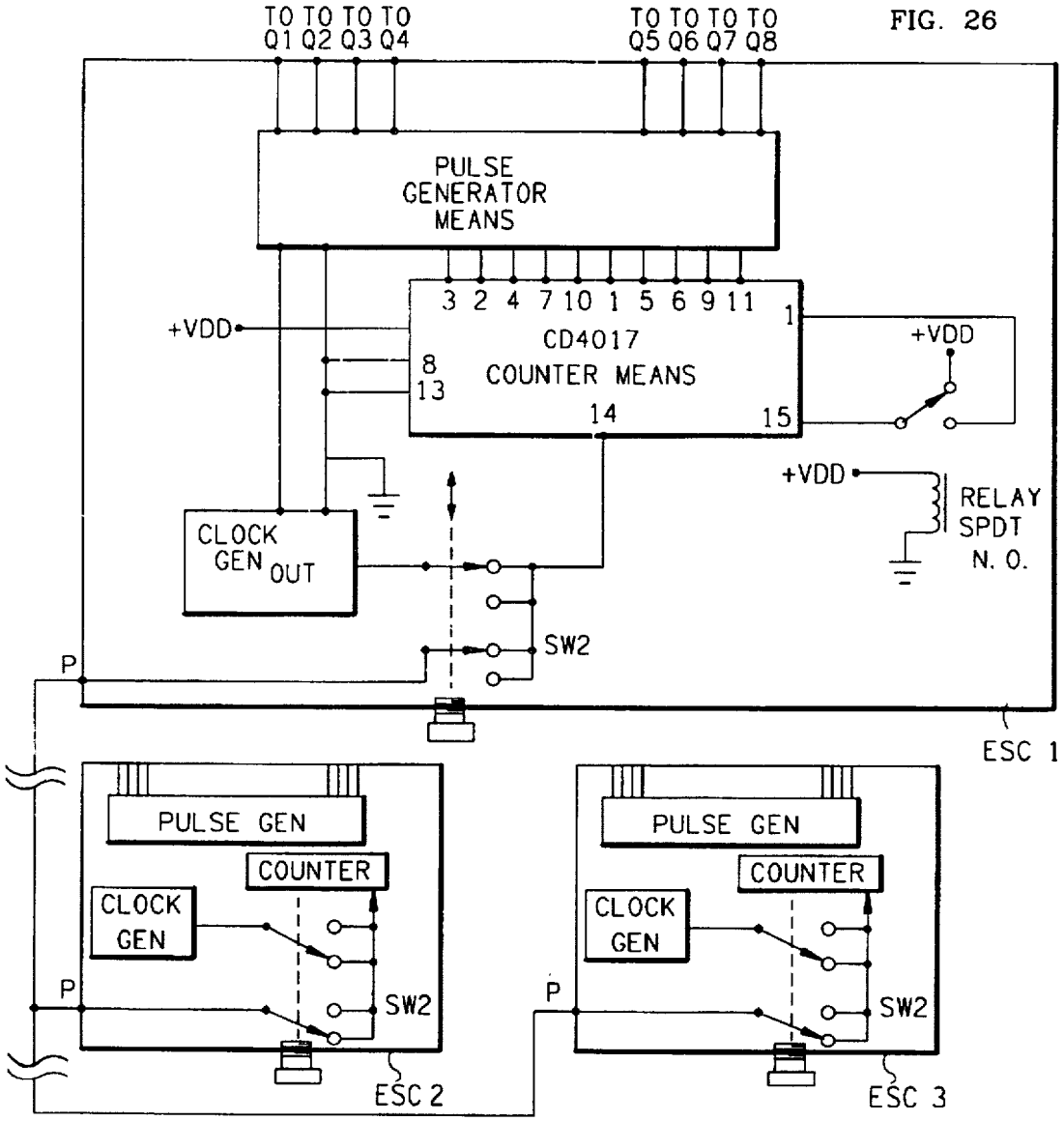
FIG. 26 is an electrical schematic diagram of a several interconnected copies of a second preferred embodiment of a sequencing counter with automatic reset means in accordance with the present invention which, when combined with a standard sequential light controller adapted to the purposes of the present invention (as shown in FIG. 1), permits of (i) start coordination between multiple separate arrays of lights, and (ii) lockstep sequencing (cycling) between the separate arrays.

The first preferred embodiment of the electronic sequencing controller, or counter shown in FIG. 25 is not the only one possible. Another, major, second embodiment of the electronic sequencing controller, or counter, is shown (trice replicated) in the schematic diagram of FIG. 26. The switch SW1 of the first embodiment of FIG. 25 is no longer present. Instead a new switch SW2 gates the clock signal from some CLOCK GEN(erator) to the COUNTER MEANS. The switch SW2 of one only of the several (three) electronic switching controllers ESC 1—ESC 3 is manually set (upon initial connection and set-up) to a first position where the CLOCK GEN(erator) of the selfsame electronic switching controller is supplied both the internal COUNTER MEANS of that ESC and also to a pin P that is wire connected to the same pin of all other ESC's. In FIG. 26 the SW2 of ESC 1 (only) occupies this first position. Electronic sequencing controller, or counter, ESC 1 becomes the "Master".

Meanwhile, the switches SW2 of all others of the several (three) electronic switching controllers ESC 1–ESC 3 are manually set (upon the initial connection and set-up) to a second position where the CLOCK GEN(erator) of the "Master" electronic switching controller is supplied the internal COUNTER MEANS of that ESC through the pin P that is wire connected to the CLOCK GEN(erator) of all the Master ESC. In FIG. 26 the SW2's of electronic sequencing controllers ESC 2 and ESC 3 occupy this second position. The electronic sequencing controllers, or counters, ESC 2 and ESC 3 both become "Slaves". second position.

All the electronic sequencing controllers, or counters, so (i) switched and so (ii) interconnected may each one be combined with a standard sequential light controller adapted to the purposes of the present invention, as represented in FIG. 26 by the PULSE GENERATOR MEANS. The switched interconnection permits and produces (i) start coordination between multiple separate arrays of lights, and (ii) lockstep sequencing (cycling) between the separate arrays.

If the switches SW2 of more than one electronic sequencing controller, or counter, are both set to the first position, then the assemblage will not work, or at least work properly, However, nothing will be harmed. Conversely, unless the switches SW2 of at least one electronic sequencing controller, or counter, is set to the first position, then the assemblage will not suffice to work (to sequence) at all. Directions are provided to the user-installer.

Figure 27:
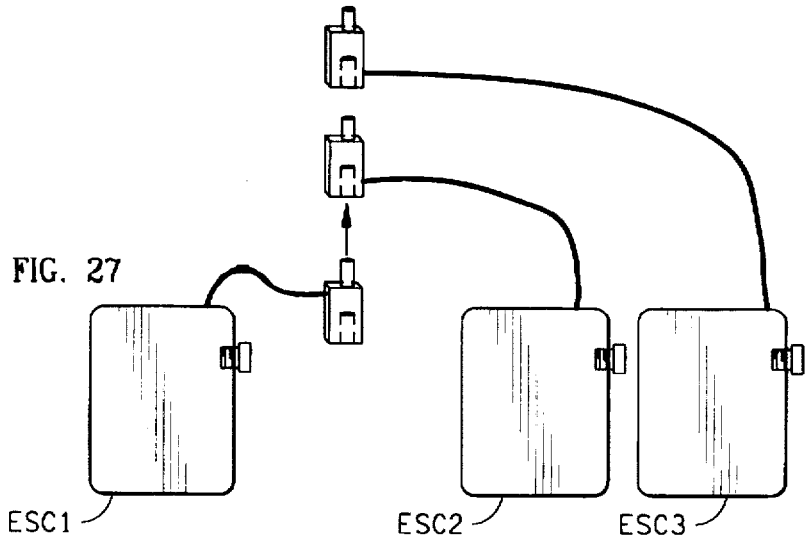
FIG. 27 is a mechanical schematic diagram of the preferred plug connection between the several interconnected copies of the second preferred embodiment of the sequencing counter with automatic reset means in accordance with the present invention previously seen in FIG. 26.

A mechanical schematic diagram of a preferred plug connection between the several interconnected copies of the second preferred embodiment of the sequencing counter with automatic reset means in accordance with the present invention (previously seen in FIG. 26) is shown in FIG. 27. The preferred connectors are (i) pluggable, and (ii) piggyback with both male and female ends, one connecting to the next in a row.

The above circuits are basic representations counters with automatic reset means, and the present invention is not limited to the above circuits only, but is instead extendible to all circuit means capable of performing the (i) synchronization and/or the (ii) time-related sequencing functions for use with the electronic sequence controller for festival (Christmas) lights for purposes of multi-set synchronization or other related lighting functions.

In accordance with the preceding explanation, variations and adaptations of the multi-dimensionally controlled arrayed lights in accordance with the present invention will suggest themselves to a practitioner of the electrical arts. Despite the great number of versatile displays realized, both the sequencing control and the power gating of the preferred embodiment of the present invention have been conventionally, and inexpensively realized. It is, however, possible to make this control more sophisticated. It is possible, for example, to drive the individual lights at multiple voltage levels. For example, there is normally but one (switched) ground bus, but two or more sources of current may be both independently switched, and additive. The typical response of the lights so controlled is to light more brightly when more current is applied, and less brightly when less current is applied.

It has clearly been possible to extend the principles of the present invention to three-dimensional arrays of lights such as may be, for example, upon stings traversing a volume. Although each individual light remains connected to two, and not three, buses for the receipt of each of (i) voltage and (ii) ground, the manner of ordering and sequencing the array can essentially cause the same effects to transpire in planes, or spherical "shells", within a volume as transpire in lines and arcs within the two-dimensionally arrayed lights.

However, consider the coordination that is possible between the display light arrays of the present invention. Two such arrays occupying two typically adjoining volumes may be set up so as to illuminate oppositely, as if one volume was a mirror image of the other.

Furthermore, and alternatively, the same volume may be "occupied" by multiple separate arrays (which are but minute lights on strings). In fact, a volume may typically be wired with wires along each of its X, Y, and Z axis—or three arrays co-occupying a same physical volume. Obviously the illumination displays produced can become very complex. In this regard, both (i) artistry and (ii) color become important. It is anticipated that creative designers will take multiple standard sets of display light arrays in accordance with the present invention, selectively change bulbs to desires colors, mount to two and three-dimensional surfaces, and lock each light controller into an individual mode or modes such as, in composite, produces a substantially custom illumination display. In this regard the versatile use of the display light arrays in accordance with the present invention mimics the use of standard Christmas tree light strings, which can be deployed in many different manners to many different effects from subtle and profound to comical.

In accordance with these and other possible variations and adaptations of the present invention, the scope of the invention should be determined in accordance with the following claims, only, and not solely in accordance with that embodiment within which the invention has been taught.

What is claimed is:

1. An electrical system electrically connected between a system voltage and a system ground for producing decorative patterns of display in a multiplicity of lights, the system comprising;

a multiplicity of arrayed lights each for emitting illumination when electrically connected between the system voltage and the system ground;

a plurality of voltage distribution buses, each connected to an associated plurality of the arrayed lights, and each selectively electrically connected to the system voltage so as to carry the system voltage to the arrayed lights of the associated plurality;

a plurality of ground buses, each connected to an associated plurality of the arrayed lights, and each selectively electrically connected to the system ground so as to carry the system ground to the arrayed lights of the associated plurality;

means for selectively electrically connecting one or more of the plurality of voltage buses to the system voltage, and also for selectively electrically connecting one or more of the plurality of ground buses to the system ground, so that those individual ones of all the multiplicity of lights that are electrically connected between both a system-voltage-connected one of the plurality of voltage busses, and also to a system-ground-connected one of the plurality of ground buses, will emit illumination while other individual ones of the multiplicity of lights not then so connected will not then illuminate;

wherein selected ones of the multiplicity of arrayed lights are illuminated, producing a display.

2. The electrical system according to claim 1 wherein the multiplicity of lights are circularly arrayed.

3. The electrical system according to claim 1 wherein the multiplicity of lights are arrayed in a two-dimensional matrix.

4. The electrical system according to claim 1 wherein each of the plurality of voltage distribution buses carries system voltage to the arrayed lights of the associated plurality in electrical series.

5. The electrical system according to claim 1 wherein each of the plurality of voltage distribution buses carries system voltage to the arrayed lights of the associated plurality in electrical parallel.

6. The electrical system according to claim 1 wherein each of the plurality of ground buses carries system ground to the arrayed lights of the associated plurality in electrical parallel.

7. The electrical system according to claim 1 wherein each of the plurality of ground buses carries system ground to the arrayed lights of the associated plurality in electrical series.

8. The electrical system according to claim 1 wherein the means for selectively energizing momentarily (i) electrically connects all the plurality of voltage buses to the system voltage, and, concurrently, (ii) electrically connects all the plurality of ground buses to the system ground;

therein momentarily illuminating all the multiplicity of lights.

9. The electrical system according to claim 1 wherein the means for selectively energizing momentarily (i) electrically connects all the plurality of voltage buses to the system voltage, and, concurrently, (ii) electrically connects in successive rotation all the plurality of ground buses to the system ground;

therein momentarily illuminating in rotation successive pluralities of the multiplicity of lights, which pluralities are respectively connected to the plurality of ground buses.

10. The electrical system according to claim 1 wherein the means for selectively energizing momentarily (i) electrically connects all the plurality of ground buses to the system ground, and, concurrently, (ii) electrically connects in successive rotation all the plurality of voltage buses to the system voltage;

therein momentarily illuminating in rotation successive pluralities of the multiplicity of lights, which pluralities are respectively connected to the plurality of voltage buses.

11. The electrical system according to claim 1 wherein the means for selectively energizing momentarily (i) electrically connects in successive rotation all the plurality of ground buses to the system ground, and, concurrently, momentarily (ii) electrically connects in successive rotation all the plurality of voltage buses to the system voltage;

therein momentarily illuminating in rotation successive ones of the multiplicity of lights.

12. The electrical system according to claim 1 wherein the multiplicity of arrayed lights emit light in a plurality of colors.

13. The electrical system according to claim 12 wherein the multiplicity of arrayed lights are arrayed in a geometric pattern.

14. The electrical system according to claim 13 wherein the plural colors of the multiplicity of arrayed lights are also in a geometric pattern.

15. A plurality of the electrical systems according to claim 1 wherein each comprises:

a means for synchronizing an onset of a succession of sequential displays with others of the plurality of systems.

16. The plurality of the electrical systems according to claim 15 wherein the means for synchronizing the onset of a succession of sequential displays is also for determining the rate of successive sequential displays.

17. The plurality of the electrical systems according to claim 16 wherein the means for synchronizing the onset and for determining the rate of successive sequential displays is so determining the rate in consideration of the rate of at least one other of the plurality of systems.

18. The plurality of the electrical systems according to claim 17 wherein the means for synchronizing the onset and for determining the rate of successive sequential displays is so determining the rate to be an integer multiple of the rate of at least one other of the plurality of systems.

19. The electrical system according to claim 1 further comprising:

one or more substantially planar substrates each for holding a plurality of the multiplicity of lights in a regular geometrical array.

20. The electrical system according to claim 19 wherein the one or more substantially planar substrates are substantially rectangular, and hold a plurality of the multiplicity of lights in a regular rectangular array.

21. The electrical system according to claim 19 wherein the one or more substantially planar substrates are substantially circular, and hold a plurality of the multiplicity of lights in a regular circular array.

22. A method of selectively electrically energizing an arrayed multiplicity of lights to display patterns, the method comprising;

partitioning the arrayed multiplicity of lights among a plurality of voltage distribution buses each of which voltage distribution buses connects to an associated plurality of the arrayed lights, and each of which voltage distribution buses is selectively electrically connected to a system voltage so as to carry the system voltage to the arrayed lights of the associated plurality;

further partitioning the same arrayed multiplicity of lights among a plurality of ground buses, each of which ground buses connects to an associated plurality of the arrayed lights, and each of which ground buses is selectively electrically connected to the system ground so as to carry a system ground to the arrayed lights of the associated plurality;

first selectively electrically connecting one or more of the plurality of voltage buses to the system voltage; and second selectively electrically connecting one or more of the plurality of ground buses to the system ground;

wherein those individual ones of all the multiplicity of lights that are electrically connected between both a system-voltage-connected one of the plurality of voltage busses, and also to a system-ground-connected one of the plurality of ground buses, will emit illumination;

wherein other individual ones of the multiplicity of lights not then so connected to both a system-voltage-connected one of the plurality of voltage busses, and also to a system-ground-connected one of the plurality of ground buses, will not then illuminate;

wherein selected ones of the multiplicity of arrayed lights are illuminated, producing a display.

23. A light display comprising:

an arrayed multiplicity of lights;

a plurality of voltage distribution buses, each connected to an associated plurality of the arrayed lights;

a plurality of ground buses, each connected to an associated plurality of the arrayed lights;

means for selectively successively electrically connecting one or more of the plurality of voltage buses to a system voltage, and also for selectively successively electrically connecting one or more of the plurality of ground buses to a system ground, in at least the following four combinations (1) all the plurality of ground buses are connected to the system ground, and, concurrently, all the plurality of voltage buses are connected to the system voltage;

(2) all the plurality of ground buses are connected to the system ground, and, concurrently, successive ones of the plurality of voltage buses are successively connected to the system voltage;

(3) successive ones of all the plurality of ground buses are successively connected to the system ground, and, concurrently, all the plurality of voltage buses are connected to the system voltage;

(4) successive ones of all the plurality of ground buses are successively connected to the system ground, and, concurrently, successive ones of the plurality of voltage buses are successively connected to the system voltage;

wherein selected ones of the multiplicity of arrayed lights are illuminated, producing a display.

24. A system of a plurality of groups of decorative lights each group comprising:

a multiplicity of lights;

an independent sequencing means sufficient in of itself without outside control for independently sequencing individual ones of the multiplicity of lights to light in succession so as to produce a stepwise sequential light display; and a means for synchronizing the independent sequencing means with the independent sequencing means of others of the plurality of groups when electrically connected thereto so that a succession of light displays as is produced by each and by all groups commences at the same time, the synchronizing means not interfering with the sequencing that is independently performed by the sequencing means should no other groups be so electrically connected.

25. The system according to claim 24 wherein each means for synchronizing is responsive to an application of power to the associated group of lights.

26. The system according to claim 24 wherein the means for synchronizing so that a succession of sequential displays commences at the same time is also for determining the rate at which the independent sequencing means will affect the successive sequential displays;

wherein the independent sequencing means is independent only in its sequencing function only in that it can, should it be within a group not electrically connected to another group, still function in of itself without outside control.

27. The system according to claim 26 wherein the means for synchronizing within each group, so that the onset and the rate of successive sequential displays is synchronized, is so synchronizing the rate in consideration of the rate of at least one other of the plurality of groups;

wherein, at least as regards rate, no one group nor its synchronizing means is absolutely controlling, but, instead, the synchronizing means of at least two groups interact in determining the synchronized rates of sequential display in both groups.

28. The system according to claim 27 wherein the means for synchronizing the onset and for determining the rate of successive sequential displays within one of the plurality of groups is so determining the rate within that one group to be an integer multiple of the rate of at least one other of the plurality of groups.

29. The system according to claim 24 wherein the means for synchronizing comprises:

a counter connected for continuous sequencing over a predetermined number of sequence steps;

a reset means for resetting the counter when power is first applied to the associated group of lights.

30. The system according to claim 29 wherein the counter is connected for continuous sequencing over a predetermined number of sequence steps by selective jumper wires.

31. The system according to claim 29 wherein reset means comprises:

a relay that when the power is off connects a terminal at which power is received to a reset input of the counter, the application of power serving, for a very brief period because of the delay in relay activation, to reset the counter before the relay disconnects the terminal from the counter.

32. Decorative lights comprising;

a matrix of an arbitrary number W of sub-groups of arrayed lights in a first spatial dimension, and of an arbitrary number X of sub-groups of arrayed lights in a second spatial dimension, for a total of WX sub-groups of arrayed lights;

each sub-group of arrayed lights being of an arbitrary number Y of lights in the first spatial dimension by an arbitrary number Z of lights in the second spatial dimension;

each of the YZ lights of each sub-group being uniquely electrically connected between one of a total number Y of first-type electrical busses and one of a total number Z of second-type electrical buses, where the number of lights Y in a one, first, spatial dimension of each sub-group is thus the same as the total number Y of first-type electrical busses, while the number of lights Z in the other, remaining second, spatial dimension of each sub-group is thus the same as the total number Z of second-type electrical buses, each of the YZ lights so connected illuminating when an associated one of the Y first-type electrical busses is connected to one of an electrical voltage and an electrical ground while the associated one of the Z second-type electrical busses is also connected to a remaining one of the electrical voltage and the electrical ground, and not illuminating otherwise;

where the Y first-type electrical busses of each sub-group are electrically common with the Y first-type electrical busses of every other sub-group, and are thus called Y matrix first-type electrical busses;

where the Z second-type electrical busses of each sub-group are electrically common with the Z second-type electrical busses of every other sub-group, and are thus called Z matrix second-type electrical busses;

first means for selectively electrically connecting one or more of the Y matrix first-type electrical busses to one of the electrical voltage and the electrical ground; and second means for selectively electrically connecting one or more of the Z matrix second-type electrical busses to a remaining one of the electrical voltage and the electrical ground;

wherein those YZ lights that are within each of the WX sub-groups of arrayed lights that are electrically connected to both the selectively-electrically-connected one or more of the Y matrix first-type electrical busses, and also (ii) the (i) the selectively-electrically-connected one or more of the Z matrix second-type electrical busses, will illuminate while no others of the lights will so illuminate;

wherein if the YZ lights of each sub-group are in the same relative spatial positions relative to their electrical connections to the Y matrix first-type electrical busses, and relative to the Z matrix second-type electrical busses, then those particular lights that are at any one time illuminating in each of the WX sub-groups of arrayed lights that are within the matrix will be spatially related, and will form a co-ordinated decorative display of lights not just from a single sub-group, but rather from a matrix consisting of the W sub-groups of arrayed lights in a first dimension, and the X sub-groups of arrayed lights in a second dimension;

wherein co-ordination of light illuminations in a matrix of sub-groups of arrayed lights is realized.

33. The decorative lights according to claim 32 wherein the matrix is of plurality W of sub-groups of arrayed lights in a first dimension, and of 2 sub-groups of arrayed lights in a second dimension, for a total of $W\times2=2W$ sub-groups of arrayed lights;

wherein each sub-group of arrayed lights is of a square dimension of Y=Z lights by Y=Z lights, or $Y^2$ lights;

wherein each of the $Y\times Y=Y^2$ lights of each sub-group is uniquely electrically connected between one of Y first-type electrical voltage busses and one of Y second-type ground buses;

wherein the Y electrical voltage busses of each sub-group are electrically common with the Y electrical voltage busses of every other sub-group;

wherein the Y electrical ground busses of each sub-group are common with the Y electrical ground busses of every other sub-group;

wherein the first means for selectively electrically connecting is connecting one or more of the Y matrix electrical voltage busses to electrical voltage;

wherein the second means for selectively electrically connecting is connecting one or more of the Y matrix ground busses to ground;

wherein those the lights that are within each of the $Y\times Y=Y^2$ sub-groups of arrayed lights that are electrically connected to both the selectively electrically connected one or more of the Y matrix electrical voltage busses, and also to the selectively electrically connected one or more of the Y matrix ground busses, will illuminate while no others of the lights will so illuminate; and wherein if the $Y\times Y=Y^2$ lights of each sub-group are in the same relative spatially positions relative to their electrical connections to the Y electrical voltage busses, and relative to the Y electrical ground busses, then those particular lights at any one time illuminating in each of the $W\times2=2W$ sub-groups of arrayed lights that are within the matrix will be spatially related, and a coordinated decorative display of lights not just from a single sub-group, but rather from the matrix of the W sub-groups of arrayed lights in a first dimension, and the 2 sub-groups of arrayed lights in a second dimension, will be produced.

34. The decorative lights according to claim 33 wherein W equals 3; and wherein Y equals 2;

wherein the matrix is thus of 3 sub-groups of arrayed lights in a first dimension, and of 2 sub-groups of arrayed lights in a second dimension, for a total of $3\times2=6$ sub-groups of arrayed lights;

wherein each sub-group of arrayed lights is of dimension 4 lights by 4 lights;

wherein each of the $4\times4=16$ lights of each sub-group are uniquely electrically connected between a one of 4 first-type electrical voltage busses and a one of 4 second-type ground buses;

wherein the 4 electrical voltage busses of each sub-group are electrically common with the 4 electrical voltage busses of every other sub-group;

wherein the 4 electrical ground busses of each sub-group are electrically common with the 4 electrical ground busses of every other sub-group;

wherein the first means for selectively electrically connecting some one or more of the 4 matrix electrical voltage busses to electrical voltage;

wherein the second means for selectively electrically connecting is connecting one or more of the 4 matrix ground busses to ground;

wherein those lights that are within each of the 4×4=16 sub-groups of arrayed lights that are electrically connected to both the selectively electrically connected one or more of the 4 matrix electrical voltage busses, and also to the selectively electrically connected one or more of the 4 matrix ground busses, will illuminate while no others of the lights will so illuminate; and wherein if the 4×4=16 lights of each sub-group are in the same relative spatially positions relative to their electrical connections to the 4 electrical voltage busses, and relative to the 4 electrical ground busses, then those particular lights at any one time illuminating in each of the 3×2=6 sub-groups of arrayed lights that are within the matrix will be spatially related, and a co-ordinated decorative display of lights not just from a single sub-group, but rather from the matrix of the 3 sub-groups of arrayed lights in a first dimension, and the 2 sub-groups of arrayed lights in a second dimension, will be produced.

35. To a method of selectively activating decorative lights distributed among and between a number of voltage buses and a ground by selectively sequentially powering one and then another voltage bus so as to cause the lights associated with each voltage bus to selectively sequentially illuminate, an improvement directed to enhancing the sophistication of the selective sequential illuminations of the decorative lights, the improvement method further comprising:

distributing the same decorative lights that are distributed among the number of voltage buses among and between these voltage buses and a number of ground buses; and selectively sequentially grounding one and then another ground bus so as to cause those of the lights that are associated with each ground bus, and that are also associated with a voltage bus that is concurrently powered, to selectively illuminate, all those lights not connected between a ground bus that is grounded and a voltage bus that is concurrently powered failing to illuminate.

36. The method according to claim 35 applied to a rectangular array of lights with the voltage buses running perpendicular to the ground buses, therein to produce successive sequential patterns of illumination that appear to move diagonally within the rectangular array.

37. The method according to claim 35 applied to a circular array of lights with a one of the voltage and ground buses running radially and the other of the voltage and ground buses running cicumferentially, therein to produce successive sequential patterns of illumination that appear to move on chords within the circular array.

* * * * *